US009250546B2

(12) United States Patent
Kameyama et al.

(10) Patent No.: US 9,250,546 B2
(45) Date of Patent: Feb. 2, 2016

(54) MEMBER FOR ELECTROPHOTOGRAPHY, PROCESS CARTRIDGE, AND ELECTROPHOTOGRAPHIC APPARATUS

(71) Applicant: CANON KABUSHIKI KAISHA, Tokyo (JP)

(72) Inventors: Naoto Kameyama, Kawasaki (JP); Kenji Onuma, Machida (JP); Rieko Sakamoto, Kawasaki (JP); Yasushi Shimizu, Yokohama (JP); Koichi Sato, Kawasaki (JP); Kimihiro Yoshimura, Yokohama (JP); Akira Watanabe, Yokohama (JP); Maho Tanaka, Tokyo (JP); Shigeki Takishita, Moriya (JP); Hiroshi Tominaga, Kashiwa (JP); Keiji Karube, Toride (JP); Takenori Sueoka, Tsukuba (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 14/313,221

(22) Filed: Jun. 24, 2014

(65) Prior Publication Data

US 2014/0377695 A1 Dec. 25, 2014

(30) Foreign Application Priority Data

Jun. 25, 2013 (JP) ..... 2013-133200

(51) Int. Cl.
*G03G 5/00* (2006.01)
*G03G 5/147* (2006.01)

(52) U.S. Cl.
CPC ..... *G03G 5/14791* (2013.01); *G03G 5/14708* (2013.01); *G03G 5/14726* (2013.01); *G03G 2215/16* (2013.01)

(58) Field of Classification Search
CPC ..... G03G 5/14708
USPC ..... 430/66
See application file for complete search history.

(56) References Cited

FOREIGN PATENT DOCUMENTS

JP 2008-233893 A 10/2008
JP 2012-078801 A 4/2012

*Primary Examiner* — Mark A Chapman
(74) *Attorney, Agent, or Firm* — Canon U.S.A. Inc., IP Division

(57) ABSTRACT

A member for electrophotography having a multilayer structure or a single-layer structure, including an outermost layer which satisfies the following A, B and C:

A: the outermost layer has perfluoropolyether and a binder resin, and in the outermost layer, the ratio of the number of fluorine atoms to the number of carbon atoms is 0.10 or more and 0.40 or less;

B: in a $^{19}$F-NMR spectrum of the outermost layer, the relaxation time T2 of a peak derived from $CF_2$ moieties of perfluoropolyether is 13 milliseconds or more at 22° C.; and C: the total sum of the contents of $CF_3$ moieties, $CF_2$ moieties, and CF moieties in the binder resin is 5% by mass or less.

9 Claims, 1 Drawing Sheet

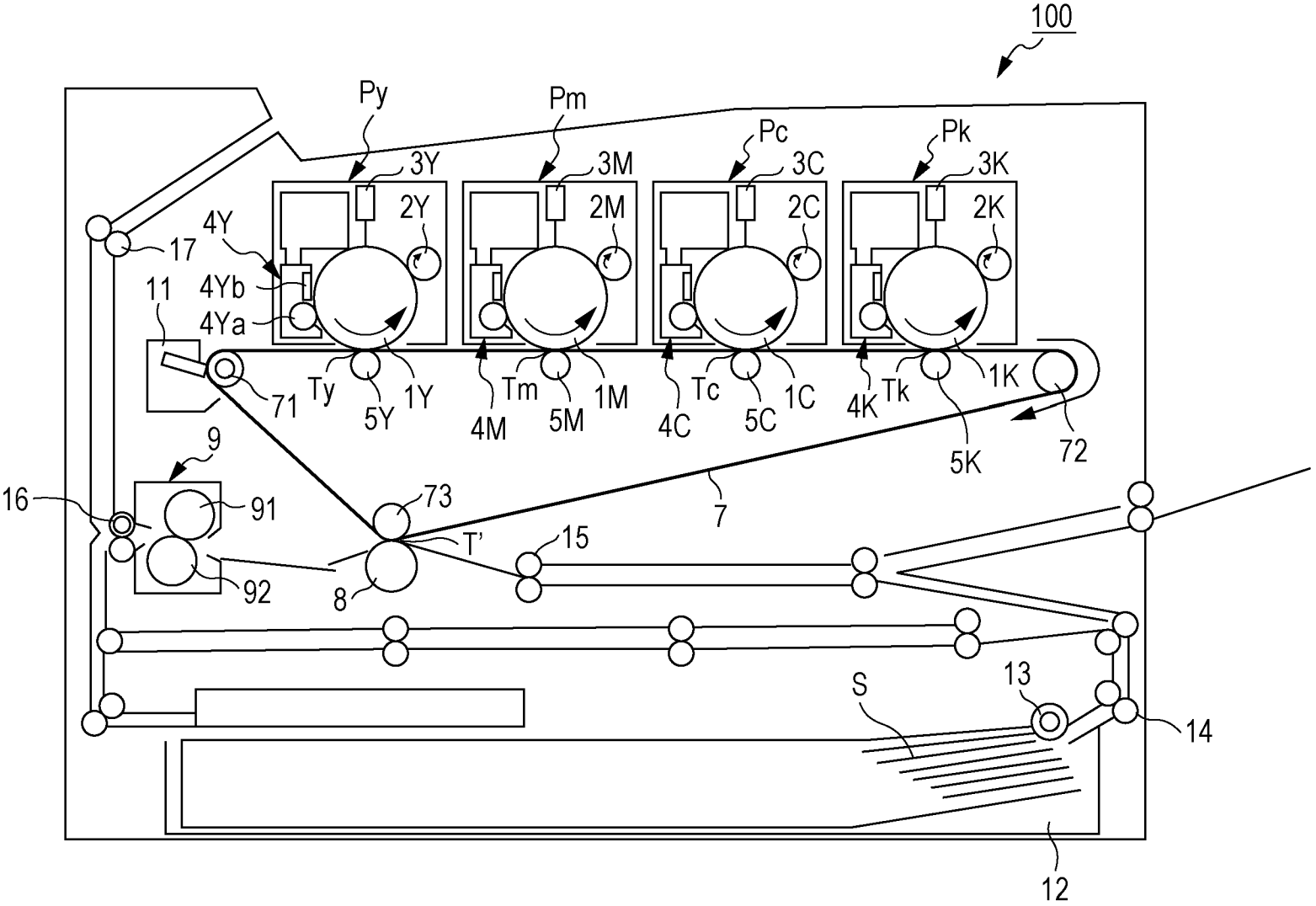
100
Py
Pm
Pc
Pk
3Y
3M
3C
3K
2Y
2M
2C
2K
1Y
1M
1C
1K
5Y
5M
5C
5K
Ty
Tm
Tc
Tk
4Y
4M
4C
4K
4Yb
4Ya
71
72
73
7
8
9
91
92
11
17
16
15
T'
13
14
12
S

MEMBER FOR ELECTROPHOTOGRAPHY, PROCESS CARTRIDGE, AND ELECTROPHOTOGRAPHIC APPARATUS

BACKGROUND OF THE INVENTION

1. Field of the Invention

The present invention relates to a member for electrophotography used in electrophotographic image-forming apparatuses such as copiers and printers and a process cartridge and an electrophotographic apparatus that include the member for electrophotography.

2. Description of the Related Art

Among electrophotographic image-forming apparatuses such as copiers and printers (hereafter, also referred to as "electrophotographic apparatus"), an electrophotographic apparatus capable of printing high-quality color images has been on the market.

Generally, a color image is formed as follows.

A toner image of each color is developed on a photosensitive member. The toner image of each color is then successively transferred onto an intermediate transfer member to form a color toner image on the intermediate transfer member. The color toner image formed on the intermediate transfer member is re-transferred onto a recording medium at a time. Thus, a recording medium on which a color toner image is formed is obtained.

In this manner, toners are brought into contact with members for electrophotography, such as a photosensitive member and an intermediate transfer member, until the toners are transferred onto a recording medium. Therefore, the surfaces of the members for electrophotography desirably have toner releasability in order to suppress melt-adhesion of toners to the members for electrophotography. Furthermore, the members for electrophotography are driven while being brought into contact with each other. Accordingly, degradation of the members for electrophotography caused by friction is desirably suppressed. Therefore, the surfaces of the members for electrophotography desirably also have resistance to friction.

Accordingly, there have been proposed methods in which the surface of a member for electrophotography is coated with a fluorine compound in order to improve toner releasability and resistance to friction. In Japanese Patent Laid-Open No. 2012-78801, a surface layer including a polymerizable fluorine resin/polymerizable siloxane-graft resin is disposed on an intermediate transfer belt in order to improve the toner releasability and resistance to friction of the surface of an intermediate transfer member. In Japanese Patent Laid-Open No. 2008-233893, the surface layer of a photosensitive member is hard-coated with a fluorine-based material and fine lubricating particles are added to the surface layer in order to improve the resistance to friction of the surface of the photosensitive member.

In these methods, the resistance to friction and toner releasability of a member for electrophotography at the initial stage of printing can be improved with certainty. However, it has been found that the toner releasability and resistance to friction of a member for electrophotography may fail to be maintained when a number of pages are printed.

SUMMARY OF THE INVENTION

Accordingly, the present invention is directed to providing a member for electrophotography capable of maintaining toner releasability and resistance to friction even when images are repeatedly transferred from and onto the member for electrophotography and capable of producing good images over a long period of time, and a process cartridge and an electrophotographic apparatus that include the member for electrophotography.

According to one aspect of the present invention, there is provided a member for electrophotography having a multilayer structure or a single-layer structure, comprising an outermost layer which satisfies the following A, B and C.

A: the outermost layer has perfluoropolyether and a binder resin, and in the outermost layer, the ratio of the number of fluorine atoms to the number of carbon atoms ((number of fluorine atoms)/(number of carbon atoms)) is 0.10 or more and 0.40 or less.

B: in a $^{19}$F-NMR spectrum of the outermost layer, the relaxation time T2 of a peak derived from $CF_2$ moieties of perfluoropolyether is 13 milliseconds or more at 22° C.

C: the total sum of the contents of $CF_3$ moieties, $CF_2$ moieties, and CF moieties in the binder resin is 5% by mass or less.

According to another aspect of the present invention, there is provided a process cartridge detachably attachable to a main body of an electrophotographic apparatus, comprising the above-described member for electrophotography.

According to a further aspect of the present invention, there is provided an electrophotographic apparatus comprising the above-described member for electrophotography.

Further features of the present invention will become apparent from the following description of exemplary embodiments with reference to the attached drawing.

BRIEF DESCRIPTION OF THE DRAWINGS

FIGURE is a schematic diagram illustrating an example of an electrophotographic apparatus according to an embodiment of the present invention.

DESCRIPTION OF THE EMBODIMENTS

Member for Electrophotography

A member for electrophotography according to an embodiment of the present invention is described below in detail.

The inventors of the present invention have found that the above-described issues may be addressed by using the following member for electrophotography and thus made the present invention.

Specifically, the present invention provides a member for electrophotography having a multilayer structure or a single-layer structure, comprising an outermost layer which satisfies the following A, B and C.

A: the outermost layer has perfluoropolyether and a binder resin, and in the outermost layer, the ratio of the number of fluorine atoms to the number of carbon atoms ((number of fluorine atoms)/(number of carbon atoms)) is 0.10 or more and 0.40 or less.

B: in a $^{19}$F-NMR spectrum of the outermost layer, the relaxation time T2 of a peak derived from $CF_2$ moieties of perfluoropolyether is 13 milliseconds or more at 22° C.

C: the total sum of the contents of $CF_3$ moieties, $CF_2$ moieties, and CF moieties in the binder resin is 5% by mass or less.

The inventors assume that the detailed reasons why the above-described issues are addressed by providing such an outermost layer are as follows.

The inventors have conducted studies on a phenomenon where resistance to friction and toner releasability are less likely to be maintained when a number of pages are printed. As a result, it has been considered that the following two points may be the main causes.

One of the potential causes is chemical degradation where C—C bonds and C—F bonds of perfluoropolyether (hereafter, also referred to as "PFPE") that is present on the surface of the member for electrophotography are cut due to electrical discharge during transferring. The other potential cause is physical removal of PFPE that is present on the surface of the member for electrophotography due to abrasion caused by the member for electrophotography being brought into contact with other members such as a cleaning member.

Actually, when the surface of a member for electrophotography coated with PFPE was subjected to electrical discharge, it was confirmed that the fluorine density on the surface of the member for electrophotography that had been subjected to electrical discharge was reduced compared with the fluorine density on the surface of a member for electrophotography that had not yet been subjected to electrical discharge.

In order to address this issue, in this embodiment, PFPE having high molecular mobility is added to the outermost layer of the member for electrophotography. Specifically, when PFPE on the surface of the member for electrophotography is lost due to electrical discharge or abrasion, PFPE in the outermost layer, which has high molecular mobility, migrates to the surface of the member for electrophotography, which suppresses a reduction in the amount of PFPE that is present on the surface of the member for electrophotography. This allows PFPE to be present on the surface of the member for electrophotography even when a number of pages are printed, which realizes maintenance of the toner releasability and resistance to friction of the member for electrophotography.

The driving forces that cause PFPE to migrate to the surface of the member for electrophotography are considered to be due to the following two points.

One of the points is related to the density gradient of PFPE between the surface and outermost layer of the member for electrophotography. It is considered that, when the amount of PFPE that is present on the surface of the member for electrophotography is reduced, PFPE in the outermost layer is likely to migrate to the surface of the member for electrophotography in order to keep the amount of PFPE that is present on the surface of the member for electrophotography and the content of PFPE in the outermost layer in balance.

The other point is related to a binder resin having a low fluorine content. It is considered that, when the binder resin constituting the outermost layer has a low fluorine content, the affinity between the binder resin and PFPE having a high fluorine content becomes low, which causes PFPE to be more likely to migrate to the surface of the member for electrophotography.

On the basis of the above-described reasons, it is considered that, when PFPE on the surface of the member for electrophotography is lost due to electrical discharge or abrasion, PFPE that is present inside the outermost layer migrates to the surface of the member for electrophotography, and thereby the amount of PFPE that is present on the surface of the member for electrophotography is kept constant, which maintains the toner releasability and resistance to friction of the member for electrophotography.

Actually, when several thousands of pages were printed using the member for electrophotography according to the embodiment and subsequently the amount of PFPE that was present on the surface of the member for electrophotography was determined by electron spectroscopy for chemical analysis (ESCA), a reduction in the amount of PFPE which occurred during printing was able to be suppressed compared with a member for electrophotography whose surface was simply coated with PFPE. Furthermore, it was observed that, in the case where the member for electrophotography according to the embodiment was used, the amount of PFPE present was increased after the lapse of a few hours from printing compared with the amount of PFPE that was present on the surface of the member for electrophotography immediately after printing. It is assumed that this phenomenon is due to the migration of PFPE from the outermost layer to the surface of the member for electrophotography.

In the outermost layer of the member for electrophotography according to the embodiment, the ratio of the number of fluorine atoms to the number of carbon atoms ((number of fluorine atoms)/(number of carbon atoms)) is 0.10 or more and 0.40 or less. This limitation means that a certain amount of PFPE is present in the outermost layer according to the embodiment.

In a $^{19}$F-NMR spectrum of the outermost layer of the member for electrophotography according to the embodiment, the relaxation time T2 of a peak derived from $CF_2$ moieties of PFPE is 13 milliseconds or more at 22° C. The relaxation time T2 is preferably 13 milliseconds or more and 50 milliseconds or less.

In nuclear magnetic resonance (NMR), the term "relaxation" refers to a phenomenon where nuclei excited by receiving an electromagnetic wave emit energy and then return to the ground state.

There are two types of relaxation: spin-lattice relaxation referred to as "longitudinal relaxation" and spin-spin relaxation referred to as "transverse relaxation". The process of relaxation is characterized by a time constant referred to as "relaxation time" In particular, it is known that the relaxation time T2 of transverse relaxation has a correlation with molecule mobility; the longer the relaxation time T2, the higher the molecule mobility.

In this embodiment, the relaxation time T2 of PFPE in the outermost layer is 13 milliseconds or more. This means, PFPE present in the outermost layer has high molecular mobility. For example, in the case where PFPE in the outermost layer is bonded to the binder resin constituting the outermost layer by covalent bond, the molecular mobility of PFPE in the outermost layer becomes low. In other words, the relaxation time T2 of PFPE becomes short. In addition, setting the relaxation time T2 of PFPE in the outermost layer to 50 milliseconds or less enables PFPE to move from the outermost layer to the surface of the member for electrophotography over a long period of time.

As described above, since the outermost layer contains PFPE having adequately high molecular mobility, toner releasability and resistance to friction can be maintained even when images are repeatedly transferred from and onto the member for electrophotography.

The total sum of the contents of $CF_3$ moieties, $CF_2$ moieties, and CF moieties in the binder resin constituting the outermost layer of the member for electrophotography according to the embodiment is 5% by mass or less.

This limitation means that, when C—F bonds are present in the molecules of the binder resin constituting the outermost layer according to the embodiment, the number of C—F bonds is equal to or less than a certain number. In particular, it is preferable that the binder resin does not include C—F bonds in its molecules. Such a binder resin has relatively low affinity for PFPE including a number of fluorine atoms in the molecules of PFPE. As a result, the mobility of PFPE in the outermost layer becomes high compared with the case where a binder resin including a plenty of fluorine atoms is used.

As described above, a member for electrophotography according to the embodiment which satisfies the above-described A, B and C includes an outermost layer having PFPE having high mobility. This allows a certain amount of PFPE to be consistently present on the surface of the outermost layer even in the case where the member for electrophotography is repeatedly used for forming electrophotographic images over a long period of time. It is considered that, therefore, the toner releasability and resistance to friction of the member for electrophotography may be maintained over a long period of time.

Components Constituting Member for Electrophotography

The member for electrophotography is not particularly limited as long as it is a member that is used in an electrophotographic process and that requires toner releasability or resistance to friction.

In particular, the member for electrophotography is preferably an intermediate transfer member for electrophotography or a photosensitive member for electrophotography.

The member for electrophotography may be used in the form of a belt, a roller, or the like. The form of the member for electrophotography is not limited and may be selected appropriately depending on the application.

The member for electrophotography may have a multilayer structure or a single-layer structure.

The components constituting the member for electrophotography are described below taking a belt-like member for electrophotography as an example.

Base Layer

The member for electrophotography may have a base layer in addition to the outermost layer.

The base layer constituting the member for electrophotography may be a semiconductive film formed of a resin including a conducting agent.

The resin may be a thermosetting resin or a thermoplastic resin. From the viewpoints of high strength and high durability, the base layer preferably includes polyimide, polyamide-imide, polyetheretherketone, polyphenylene sulfide, or polyester. More preferably, the base layer includes polyimide, polyamide-imide, or polyetheretherketone.

The resin may be a single resin or a resin mixture prepared by blending or alloying a plurality of resins. The resin is selected appropriately depending on the target properties such as mechanical strength.

Examples of the conducting agent include an electron conductive material and an ion conductive material.

Examples of the electron conductive material include carbon black, antimony-doped tin oxide, titanium oxide, and a conductive polymer.

Examples of the ion conductive material include sodium perchlorate, lithium, a cationic or anionic surface-active agent, a nonionic surface-active agent, and an oligomer or a polymer having an oxyalkylene repeating unit.

The volume resistivity of the base layer is preferably $1.0\times10^{7}\Omega\cdot$cm or more and $1.0\times10^{12}\Omega\cdot$cm or less. The surface resistivity of the base layer is preferably $1.0\times10^{8}$ Ω/sq or more and $1.0\times10^{14}$ Ω/sq or less.

By setting the volume resistivity of the base layer within the above range, occurrence of charge-up during continuous operation and occurrence of image defects due to insufficient transfer bias may be suppressed.

By setting the surface resistivity of the base layer within the above range, occurrence of separating discharge at the time when a transfer material S is removed from an intermediate transfer belt 7 and occurrence of image defects due to toner scattering may be suppressed.

The volume resistivity and surface resistivity of the member for electrophotography, which is produced by forming an outermost layer on the base layer, are preferably at the same level as the above ranges.

Thus, the outermost layer of the member for electrophotography also preferably has semiconductivity. Specifically, the volume resistivity of the member for electrophotography is preferably $1.0\times10^{7}\Omega\cdot$cm or more and $1.0\times10^{12}\Omega\cdot$cm or less. The surface resistivity of the member for electrophotography is preferably $1.0\times10^{8}$ Ω/sq or more and $1.0\times10^{14}$ Ω/sq or less.

The outermost layer may include a conducting agent in order to control the volume resistivity and surface resistivity of the member for electrophotography. The conducting agent added to the outermost layer may be the same conducting agent as that used in the base layer described above.

The thickness of the base layer is preferably 30 μm or more and 150 μm or less.

Outermost Layer

The outermost layer of the member for electrophotography is described below.

Binder Resin

A binder resin is added to the outermost layer in order to disperse PFPE in the outermost layer, to maintain the adhesiveness of the outermost layer to the base layer, and to maintain the mechanical strength of the outermost layer.

In the binder resin according to the embodiment, the total sum of the contents of $CF_3$ moieties, $CF_2$ moieties, and CF moieties is 5% by mass or less.

Examples of the binder resin include a styrene resin, an acrylate resin, a methacrylate resin, an epoxy resin, a polyester resin, a polyether resin, a silicone resin, a polyvinyl butyral resin, and a mixture of the two or more of these resins.

Among these binder resins, in particular, a methacrylate resin and an acrylate resin (hereafter, methacrylate resin and acrylate resin are collectively referred to as "acrylic resin") are preferably used.

Specifically, a polymerizable monomer used for forming an acrylic resin, a solvent, perfluoropolyether, and a dispersing agent are uniformly mixed using a wet-type dispersion device to form a dispersion. A base layer is coated with the dispersion by an application method such as bar coating or spray coating. The dispersion deposited on the base layer is dried to remove the solvent therefrom. Subsequently, the polymerizable monomer is polymerized by heat curing or using an electron beam or ultraviolet radiation to form an outermost layer.

A polymerization initiator may be used as needed in order to perform the polymerization.

Examples of the polymerization initiator include radical polymerization initiators such as alkylphenone and acylphosphine oxide, cationic polymerization initiators such as aromatic sulfonium salt, and anionic polymerization initiators such as nifedipine. A specific example of the radical polymerization initiators is the IRGACURE series (produced by BASF SE). A specific example of the cationic polymerization initiators is the SP series (produced by ADEKA corporation).

Any publicly known additives such as the above-described conducting agent, an antioxidant, a leveling agent, a crosslinking agent, and a flame retardant may be added to the binder resin as needed. A solid filler may be added to the binder resin as needed depending on the required properties, for example, in order to increase strength.

The content of the binder resin is preferably 20.0% by mass or more and 95.0% by mass or less and more preferably 30.0% by mass or more and 90.0% by mass or less based on the total solid content in the outermost layer.

The thickness of the outermost layer may be set to a desired thickness as needed by controlling the film-deposition conditions (e.g., solid content and deposition rate). With consideration of abrasion and wear that occur under real-machine endurance conditions, the thickness of the outermost layer is preferably 1 μm or more. With consideration of the bending resistance of the member for electrophotography on which a belt is stretched, the thickness of the outermost layer is preferably 20 μm or less and more preferably 10 μm or less.

The acrylic resin may be a polymer having a repeating structural unit formed by polymerization of any one of the following polymerizable monomers:

(i) at least one acrylate selected from the group consisting of pentaerythritol triacrylate, pentaerythritol tetraacrylate, ditrimethylolpropane tetraacrylate, dipentaerythritol hexaacrylate, alkyl acrylate, benzyl acrylate, phenyl acrylate, ethylene glycol diacrylate, and bisphenol A diacrylate; and (ii) at least one methacrylate selected from the group consisting of pentaerythritol trimethacrylate, pentaerythritol tetramethacrylate, ditrimethylolpropane tetramethacrylate, dipentaerythritol hexamethacrylate, alkyl methacrylate, benzyl methacrylate, phenyl methacrylate, ethylene glycol dimethacrylate, and bisphenol A methacrylate.

The hardness of the binder resin may be high in order to reduce adhesion of toners to the member for electrophotography. Accordingly, a large amount of crosslinkable monomers having two or more functional groups may be used for forming the acrylic resin in order to increase the hardness of the binder resin. Specifically, the number of acrylic functional groups in the polymerizable monomer is preferably 2 or more, more preferably 3 or more, and further preferably 4 or more on average. Generally, the above-described resin having high cross-linking capability and high hardness tends to have a thermosetting property. In this respect, basically, thermosetting resins such as acrylic resins are preferably used in this embodiment.

The physical properties of the binder resin constituting the outermost layer are described below.

The binder resin constituting the outermost layer may be solid. The glass transition temperature of the binder resin is preferably above the operation temperature range, that is, substantially 40° C. or more, and more preferably 50° C. or more.

Perfluoropolyether (PFPE)

The term "PFPE" used herein refers to an oligomer or polymer having a perfluoroalkylene ether repeating unit. Examples of the perfluoroalkylene ether repeating unit include a perfluoromethylene ether repeating unit, a perfluoroethylene ether repeating unit, and a perfluoropropylene ether repeating unit. Specific examples of PFPE include DEMNUM produced by DAIKIN INDUSTRIES, LTD, Krytox produced by Du Pont Kabushiki Kaisha, and Fomblin produced by Solvay Solexis company. In particular, perfluoropolyether including the repeating structural unit 1 represented by Structural Formula (a) below or the repeating structural unit 2 represented by Structural Formula (b) below is preferably used.

(a)

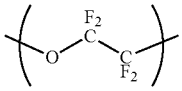

-continued (b)

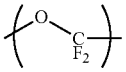

In the case where PFPE includes the repeating structural unit 1 or 2, the number of repetition p of the repeating structural unit 1 and the number of repetition q of the repeating structural unit 2 are preferably each independently $0 \leq p \leq 100$ and $0 \leq q \leq 100$ and preferably satisfy $p+q \geq 1$.

In the case where PFPE includes both the repeating structural units 1 and 2, the repeating structural units 1 and 2 may form a block-copolymer structure or a random-copolymer structure.

The weight-average molecular weight Mw of PFPE in the outermost layer is preferably 100 or more and 9,000 or less and more preferably 100 or more and 8,000 or less from the viewpoint of the ease of migration of PFPE to the surface of the member for electrophotography.

PFPE may include a reactive functional group capable of forming a bond or a state closely analogous to a bond with the binder resin constituting the outermost layer of the member for electrophotography or a nonreactive functional group that is not capable of forming a bond or a state closely analogous to a bond with the binder resin constituting the outermost layer.

In the case that the binder resin is formed by an addition reaction, the reactive functional group that can cause the addition reaction with a monomer of the binder resin may be an acryl group, a methacryl group, and an oxiranyl group.

Examples of PFPE having the reactive functional group described above include Fluorolink MD500, MD700, 5101X, 5113X, and AD1700 that include an acryl group or a methacryl group; Fluorolink S10 that includes a silane group (produced by Solvay Solexis company); and OPTOOL DAC (produced by DAIKIN INDUSTRIES, LTD.).

In the case that the binder resin is formed by an addition reaction, the nonreactive functional group that cannot cause the addition reaction with a monomer of the binder resin may be a hydroxyl group, a trifluoromethyl group, and a methyl group. Examples of PFPE having the nonreactive functional group described above include Fluorolink D10H, D4000, and Fomblin Z15 (produced by Solvay Solexis company); and DEMNUM S-20, S-65, and S200 (produced by DAIKIN INDUSTRIES, LTD.).

In particular, PFPE including the nonreactive functional group is preferably used from the viewpoint of the ease of migration of PFPE to the surface of the member for electrophotography.

The content of PFPE is preferably 10.0% by mass or more and 70.0% by mass or less, more preferably 10.0% by mass or more and 60.0% by mass or less, and further preferably 20.0% by mass or more and 50.0% by mass or less based on the total solid content in the outermost layer. By controlling the PFPE content within the above range, even when images are repeatedly transferred from and onto the member for electrophotography, PFPE may be supplied from the outermost layer of the member for electrophotography to the surface of the member for electrophotography, which further suppresses a reduction in the amount of PFPE that is present on the surface of the member for electrophotography.

In order to control the relaxation time T2 of PFPE to be 13 milliseconds or more and, in particular, 13 milliseconds or more and 50 milliseconds or less, in the outermost layer according to the embodiment, PFPE is preferably present in the outermost layer while not chemically bonded to the binder resin if possible. In this respect, PFPE that does not include the above-described reactive functional group, which is capable of forming a bond or a state closely analogous to a bond with the binder resin, is preferably selected. In the case where PFPE including the reactive functional group is used, the process for producing the member for electrophotography is preferably controlled so that the reactive functional group does not chemically react with the binder resin.

Dispersing Agent

The outermost layer of the member for electrophotography may further comprise a dispersing agent for dispersing the perfluoropolyether in the outermost layer. By adding the dispersing agent to the outermost layer, the dispersed state of PFPE in the outermost layer becomes more stable. The dispersing agent may be a compound including moieties having an affinity for a perfluoroalkyl chain and moieties having an affinity for a hydrocarbon, that is, a compound having an fluorophilic-fluorophobic amphipathic property, such as a surface-active agent, an amphipathic block copolymer, and an amphipathic graft copolymer. In particular, the following copolymers may be used:

(i) a block copolymer produced by copolymerization of a vinyl monomer having a fluoroalkyl group with an acrylate or methacrylate; and (ii) a comb-like graft copolymer produced by copolymerization of an acrylate having a fluoroalkyl group or a methacrylate having a fluoroalkyl group with a methacrylate macromonomer having a polymethyl methacrylate as a side chain.

Examples of the block copolymer described in (i) include MODIPER F200, F210, F2020, F600, and FT-600 produced by NOF CORPORATION. Examples of the comb-like graft copolymer described in (ii) include Aron GF-150, GF-300, and GF-400 produced by TOAGOSEI CO., LTD., which are fluorine-based graft polymers.

The content of the dispersing agent is preferably 1.0% by mass or more and 70.0% by mass or less and is more preferably 5.0% by mass or more and 60.0% by mass or less based on the total solid content of the outermost layer.

The dispersing agent may be a factor that is important for satisfying both the condition regarding the ratio of the number of fluorine atoms to the number of carbon atoms in the outermost layer according to the embodiment and the condition regarding the total sum of the contents of $CF_3$ moieties, $CF_2$ moieties, and CF moieties in the binder resin according to the embodiment. In other words, the dispersing agent may be used in order to increase the content of PFPE in the binder resin in which the contents of $CF_3$ moieties, $CF_2$ moieties, and CF moieties are low.

Others

The outermost layer may have conductivity depending on the properties required by the member for electrophotography. A conductive filler may be added to the outermost layer in order to impart conductivity to the outermost layer.

Any publicly known electron conductive material or ion conductive material may be used as the conductive filler. Examples of the electron conductive material include carbon black, carbon nanotube, antimony-doped tin oxide, antimony-doped zinc oxide, phosphorus-doped zinc oxide, aluminium-doped zinc oxide, gallium-doped zinc oxide, polyaniline, polythiophene, and polypyrrole. Examples of the ion conductive material include sulfonic acid potassium salt and disulfonic acid lithium salt.

Method for Producing Member for Electrophotography

A specific method for producing the member for electrophotography according to the embodiment is described below. However, the present invention is not limited to the following production method.

Base Layer

The base layer of the member for electrophotography may be prepared by the following method.

For example, in the case where a thermosetting resin is used, a conducting agent such as carbon black is mixed with a precursor of the thermosetting resin or with a soluble thermosetting resin and a solvent to form a dispersion (varnish). A mold of a centrifugal molding machine is coated with the varnish, and the resulting coating film deposited on the mold is calcined in a calcination step. Thus, a semiconductive film may be formed.

In the case where a thermoplastic resin is used, a conducting agent such as carbon black, the thermoplastic resin, and, as needed, additives are mixed, and the resulting mixture is melt-kneaded with a twin-screw kneader or the like to prepare a semiconductive resin composition. The resin composition is then extruded by melt extrusion in the form of a sheet, a film, or a seamless belt. Thus, a semiconductive film may be formed. The seamless belt may be formed by extruding the resin composition from a cylindrical die in the form of a belt. Alternatively, sheets formed by extrusion may be joined to one another to make them seamless. In another case, a semiconductive film may be formed by hot pressing or injection molding.

The semiconductive film may be subjected to a crystallization treatment in order to increase the mechanical strength and proof stress of the member for electrophotography. An example of the crystallization treatment is annealing at a temperature higher than or equal to the glass transition temperature (Tg) of the resin used, which promotes crystallization of the resin used. The member for electrophotography prepared as described above has not only high mechanical strength and high proof stress but also high wear resistance, high chemical resistance, ease of sliding, high toughness, and good flame retardancy.

The member for electrophotography is confirmed to have high mechanical strength from a tensile test JIS K 7113. Specifically, the tensile modulus of the member for electrophotography is preferably 1.5 GPa or more, more preferably 2.0 GPa or more, and further preferably 2.5 GPa or more. The tensile breaking elongation of the member for electrophotography is preferably 10% or more and more preferably 20% or more. The member for electrophotography is confirmed to have good properties from a bending fatigue test such as JIS P 8115.

Outermost Layer

The outermost layer of the member for electrophotography is prepared by the following method.

The outermost layer may be formed through the following steps:

(1) a mixing step in which perfluoropolyether, a polymerizable monomer used for forming a binder resin, a dispersing agent, and a polymerization initiator are mixed to prepare a mixture;

(2) an application step in which the mixture is applied onto the base layer; and (3) a polymerization step in which the mixture deposited on the base layer is irradiated with ultraviolet radiation to cause the polymerizable monomer to be polymerized.

In the mixing step, perfluoropolyether, a polymerizable monomer used for forming a binder resin, a dispersing agent, and a polymerization initiator are mixed using a stirring homogenizer and an ultrasonic homogenizer to prepare a mixture. A solvent, an ultraviolet curing agent, a conducting agent, and additives may be further added to the mixture. Examples of the solvent include methyl ethyl ketone (MEK), methyl isobutyl ketone (MIBK), and ethylene glycol. Examples of the ultraviolet curing agent include a photopolymerization initiator and a thermal-polymerization initiator. Examples of the additives include a conducting agent, filler particles, a coloring agent, and a leveling agent.

In the application step, the mixture is applied onto the base layer by bar coating or spray coating, and subsequently the mixture deposited on the base layer is dried at 60° C. to 90° C. to distill the solvent from the mixture.

In the polymerization step, the mixture deposited on the base layer is irradiated with ultraviolet radiation using an ultraviolet exposure system to cause the polymerizable monomer in the mixture to be polymerized. Through the above steps, the member for electrophotography according to the embodiment may be prepared. Alternatively, the belt-like body may be coated with the mixture by ring coating.

A high-pressure mercury lamp or a metal halide lamp may be used as an ultraviolet light source. The cumulative amount of ultraviolet radiation may be appropriately changed depending on the type of the monomer used and the type and amount of the photopolymerization initiator used.

Process Cartridge and Electrophotographic Apparatus

An example of an electrophotographic apparatus comprising the member for electrophotography described above that serves as an intermediate transfer member for electrophotography is described below with reference to FIGURE.

The electrophotographic apparatus 100 shown in FIGURE is an electrophotographic color-image-forming apparatus (color laser printer).

In the electrophotographic apparatus 100, image-forming units Py, Pm, Pc, and Pk are arranged along an intermediate transfer belt 7 (intermediate transfer member) in order in the direction in which the intermediate transfer belt 7 moves. The image-forming units Py, Pm, Pc, and Pk are image-forming sections for yellow (Y), magenta (M), cyan (C), and black (K), respectively. Since all the image-forming units include the same basic components, hereafter, details are described for a yellow image-forming unit Py only. Note that, a portion of the image-forming unit may be included in a process cartridge that is detachably attachable to the main body of the electrophotographic apparatus.

The yellow image-forming unit Py includes a drum-like electrophotographic photosensitive member (hereafter, referred to as "photosensitive drum") 1Y that serves as an image-carrying member. The photosensitive drum 1Y is formed by stacking a charge generation layer, a charge transportation layer, and a surface protecting layer in order on a base, which was an aluminium cylinder.

The yellow image-forming unit Py includes a charge roller 2Y (charging unit). Applying charging bias to the charge roller 2Y causes the surface of the photosensitive drum 1Y to be charged uniformly.

A laser-exposure device 3Y (image exposure unit) is disposed above the photosensitive drum 1Y. Using the laser-exposure device 3Y, scanning exposure of the surface of the photosensitive drum 1Y, which has been uniformly charged, is performed on the basis of image information. Thus, an electrostatic latent image corresponding to yellow is formed on the surface of the photosensitive drum 1Y.

The electrostatic latent image formed on the photosensitive drum 1Y is then developed using a development device 4Y (development unit) and a toner (developing agent). Specifically, the development device 4Y includes a development roller 4Ya (developing agent-carrying member) and a control blade 4Yb (member for controlling the amount of developing agent) and accommodates a yellow toner (developing agent). The development roller 4Ya supplied with the yellow toner is in low-pressure contact with the photosensitive drum 1Y in the developing section and rotates in the forward direction together with the photosensitive drum 1Y at a rotation speed different from that of the photosensitive drum 1Y. The yellow toner conveyed to the developing section using the development roller 4Ya is adhered to the electrostatic latent image formed on the photosensitive drum 1Y upon application of development bias to the development roller 4Ya. Thus, a visible image (yellow toner image) is formed on the photosensitive drum 1Y.

An intermediate transfer belt 7 (intermediate transfer member) is stretched over a drive roller 71, a tension roller 72, and a driven roller 73 and moved (rotated) in the direction of the arrow shown in FIGURE by being brought into contact with the photosensitive drum 1Y. The yellow toner image conveyed to a primary transfer section Ty is transferred onto the intermediate transfer belt 7 using a primary transfer roller 5Y (primary transfer member), which is disposed on a side of the intermediate transfer belt 7 opposite that on which the photosensitive drum 1Y is disposed and which is in pressure contact with the photosensitive drum 1Y.

An image forming operation similar to that described above is conducted in each of the image-forming units Pm, Pc, and Pk of magenta (M), cyan (C), and black (K) in accordance with movement of the intermediate transfer belt 7. Thus, a four-color toner image of yellow, magenta, cyan, and black is stacked on the intermediate transfer belt 7. The four-color toner layer is conveyed to a secondary transfer section T' in accordance with movement of the intermediate transfer belt 7. In the secondary transfer section T', the four-color toner layer is collectively transferred onto a transfer material S, which is conveyed using a secondary transfer roller 8 (secondary transfer unit) at a predetermined timing. In the secondary transfer section T', generally, a few kilovolts of transfer voltage is applied in order to achieve a sufficiently high transfer rate. This may cause electrical discharge in the vicinity of a transfer nip, which may be one of potential causes of chemical degradation of the transfer member (intermediate transfer belt).

The transfer material S is stored in a cassette 12 (transfer material storage section). The transfer material S is separately supplied to the inside of the apparatus using a pickup roller 13, synchronized with the four-color toner image, which is transferred onto the intermediate transfer belt 7, using a conveyance roller pair 14 and a registration roller pair 15, and then conveyed to the secondary transfer section T'.

The toner image is transferred onto the transfer material S and then fixed using a fixing device 9 to form, for example, a full-color image. The fixing device 9 includes a fixing roller 91 having a heating unit and a pressure roller 92. An unfixed toner image on the transfer material S is heated and pressurized using the fixing device 9 and thereby fixed on the transfer material S.

Subsequently, the resulting transfer material S is discharged to the outside of the apparatus using a conveyance roller pair 16 and a discharge roller pair 17.

A cleaning blade 11 (cleaning unit for the intermediate transfer belt 7) is disposed next to the secondary transfer section T' in the direction in which the intermediate transfer belt 7 is driven. The cleaning blade 11 is used for removing an untransferred toner that remains on the intermediate transfer belt 7, which was not transferred to the transfer material S at the secondary transfer section T'.

As described above, a process in which a toner image is electrically transferred from a photosensitive member to an intermediate transfer belt and then re-transferred from the intermediate transfer belt to a recording medium is repeatedly performed. This electrical transfer process will be further repeated while the image is repeatedly recorded on a number of transfer media.

In the above-described electrophotographic apparatus, four toner images of yellow, magenta, cyan, and black are formed in the respective image-forming units Py, Pm, Pc, and Pk of yellow (Y), magenta (M), cyan (C), and black (K) in order in accordance with movement of the intermediate transfer belt 7 and stacked on the intermediate transfer belt 7. The resulting four-color toner layer is conveyed to the secondary transfer section T' in accordance with movement of the intermediate transfer belt 7. In the secondary transfer section T', the four-color toner layer is collectively transferred onto the transfer material S, which is conveyed using the secondary transfer roller 8 (secondary transfer unit) at a predetermined timing.

EXAMPLES

An embodiment of the present invention is described in detail with reference to specific examples below. However, the present invention is not limited to the examples. Note that, "parts" and "%" always denote "parts by mass" and "% by mass", respectively, unless otherwise stated.

The materials used for producing the member for electrophotography are described below.

Materials (1) Fluorine-Acryl Graft Copolymer (1-1) Measurement of Weight-Average Molecular Weight Mw A sample to be measured was dissolved in tetrahydrofuran (hereafter, also referred to as "THF") to prepare a solution having a density of 0.2% by mass. Subsequently, the molecular weight of the solution was analyzed using a gel permeation chromatography (hereafter, also referred to as "GPC") system GPC-104 (produced by SHOWA DENKO K.K.). The molecular weight analysis was conducted using a column formed by joining one "GPC KF-603" to one "GPC KF-604" (produced by SHOWA DENKO K.K.) at a column temperature of 40° C. and at a THF flow velocity of 1.0 mL/min. The weight-average molecular weight (Mw) of the sample was calculated from a calibration curve that had been prepared using a polystyrene reference material ("SM-105", produced by SHOWA DENKO K.K.) whose molecular weight was known.

(1-2) Synthesis of Fluorine-Acryl Graft Copolymer

Graft Copolymer M50

The following materials were charged in a glass flask equipped with a stirrer, a dropping funnel, a reflux condenser, a nitrogen gas introduction tube, and a thermometer, and the resulting mixture was heated to 90° C. while being stirred under a stream of nitrogen:

| | |
|---|---|
| Methyl methacrylate (produced by Tokyo Chemical Industry Co., Ltd.) | 100 parts |
| 3-Mercaptopropionic acid (produced by Tokyo Chemical Industry Co., Ltd.) | 2.5 parts |
| Butyl acetate (produced by KISHIDA CHEMICAL Co., Ltd.) | 80 parts |

In another container, 1.0 parts of 2,2'-azobis(2-methylbutyronitrile) ("ABN-E", produced by Japan Finechem Inc.) was dissolved in 20 parts of butyl acetate to prepare a polymerization initiator solution. The polymerization initiator solution was added to the flask containing methyl methacrylate dropwise over 3 hours. The resulting mixture was heated while being stirred for 3 hours to cause polymerization. Thus, an oligomer having a carboxyl group at one end was obtained.

The nitrogen atmosphere was changed to an air atmosphere. Then, the following materials were added to the oligomer having a carboxyl group at one end:

| | |
|---|---|
| Methoxyphenol (produced by Tokyo Chemical Industry Co., Ltd.) | 0.02 parts |
| Tetrabutylammonium bromide (produced by Tokyo Chemical Industry Co., Ltd.) | 1.0 parts |
| Glycidyl methacrylate (produced by Tokyo Chemical Industry Co., Ltd.) | 3.5 parts |

The resulting mixture was heated at 110° C. for 8 hours and subsequently cooled to room temperature. Then, butyl acetate was added to the mixture to control the solid content in the mixture to be 50%. Thus, a butyl acetate solution of a macromonomer M20 having a methacryloyl group at one end was prepared.

In a glass flask equipped with a stirrer, a dropping funnel, a reflux condenser, a nitrogen gas introduction tube, and a thermometer, the following materials were charged, and the resulting mixture was heated while being stirred at 90° C. under a stream of nitrogen.

| | |
|---|---|
| The butyl acetate solution of the macromonomer M20 (70 parts in terms of solid content) | 140 parts |
| Perfluorohexyl acrylate ("CHEMINOX FAAC-6" produced by UNIMATEC Co., LTD.) | 30 parts |
| 2-Hydroxyethyl acrylate (2-mol ϵ-caprolactone adduct) ("PLACCEL FA2D" produced by Daicel Corporation) | 10 parts |
| Methyl isobutyl ketone (hereafter, also referred to as "MIBK") | 70 parts |

In another container, 2.2 parts of 2,2'-azobis(2-methylbutyronitrile) (produced by Japan Finechem Inc.) was dissolved in 20 parts of butyl acetate to prepare a polymerization initiator solution. The polymerization initiator solution was added to the flask containing the macromonomer M20 dropwise over 3 hours. The resulting mixture was heated while being stirred for 3 hours to cause polymerization. Thus, a graft copolymer M50 was obtained.

The molecular weight of the graft copolymer M50 was measured, and it was found that the graft copolymer M50 was a polymer having an weight-average molecular weight Mw of $5\times10^4$.

Graft Copolymer M20

A graft copolymer M20 was synthesized as in the synthesis of the graft copolymer M50, except that the amount of butyl acetate solution of the macromonomer M20 added was changed to 120 parts (60 parts in terms of solid content) and the amount of perfluorohexyl acrylate added was changed to 40 parts.

The molecular weight of the graft copolymer M20 was measured, and it was found that the graft copolymer M20 was a polymer having an weight-average molecular weight Mw of $2\times10^4$.

(2) Antimony-Doped Tin Oxide Fine Particle Dispersion (20 Mass %)

To 80 parts of methyl ethyl ketone, 20 parts of an antimony-doped tin oxide powder whose particles has a spherical shape ("SN-100P" produced by Ishihara Sangyo Kaisha, Ltd.) and 1 part of trioctylamine (produced by Tokyo Chemical Industry Co., Ltd.) were added. The resulting mixture was subjected to a dispersion treatment using a homogenizer "ULTRA TURRAX" (produced by IKA). Thus, an antimony-doped tin oxide fine particles 20 mass % dispersion was obtained.

(3) PFPE (3-1) Synthesis of PFPE-ACR1

In a glass flask equipped with a stirrer, a reflux condenser, a nitrogen gas introduction tube, a thermostat, and a thermometer, the following materials were mixed:

| | |
|---|---|
| PFPE diol ZDOL2000 (produced by Solvay Solexis company) | 11.4 g |
| 2-Isocyanatoethyl acrylate (produced by WAKO CHEMICAL, LTD.) | 1.692 g |

The resulting mixture was stirred in a nitrogen atmosphere, and 50 μl of a dibutyltin diacetate catalyst (produced by Tokyo Chemical Industry Co., Ltd.) was added to the mixture. Subsequently, the mixture was heated to 50° C., and the reaction was carried out for 24 hours. Thus, PFPE-ACR1 having the structure represented by Structural Formula ACR1 was obtained.

Structural Formula ACR1

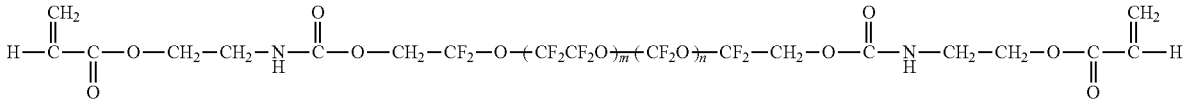

(3-2) Synthesis of PFPE-AR2

In a glass flask equipped with a stirrer, a reflux condenser, a nitrogen gas introduction tube, a thermostat, and a thermometer, the following materials were mixed:

| | |
|---|---|
| PFPE diol ZDOL2000 (produced by Solvay Solexis company) | 11.4 g |
| Hexyl isocyanate (produced by Tokyo Chemical Industry Co., Ltd.) | 1.526 g |

The resulting mixture was stirred in a nitrogen atmosphere, and 50 μl of a dibutyltin diacetate catalyst (produced by Tokyo Chemical Industry Co., Ltd.) was added to the mixture. Subsequently, the mixture was heated to 50° C., and the reaction was carried out for 24 hours. Thus, PFPE-AR2 having the structure represented by Structural Formula AR2 was obtained.

Structural Formula AR2

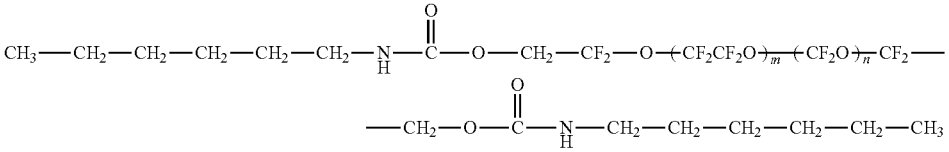

(3-3) Synthesis of PFPE-MAC3

In a glass flask equipped with a stirrer, a reflux condenser, a nitrogen gas introduction tube, a thermostat, and a thermometer, the following materials were mixed:

| | |
|---|---|
| PFPE diol ZDOL2000 (produced by Solvay Solexis company) | 11.4 g |
| Karenz MOI (produced by SHOWA DENKO K.K.) | 1.862 g |

The resulting mixture was stirred in a nitrogen atmosphere, and 50 μl of a dibutyltin diacetate catalyst (produced by Tokyo Chemical Industry Co., Ltd.) was added to the mixture. Subsequently, the mixture was heated to 50° C., and the reaction was carried out for 24 hours. Thus, PFPE-MAC3 having the structure represented by Structural Formula MAC3 was obtained.

Structural Formula MAC3

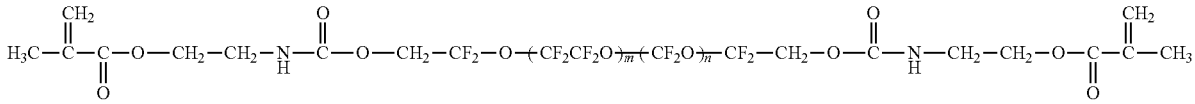

(3-4) Synthesis of PFPE-TH4

In a glass flask equipped with a stirrer, a nitrogen gas introduction tube, and a thermometer, the following materials were mixed. The resulting mixture was stirred in a nitrogen-purged environment and maintained at 0° C. in an ice-water bath.

| | |
|---|---|
| Perfluorobutanesulfonyl fluoride (produced by Tokyo Chemical Industry Co., Ltd.) | 4.98 g |
| Dehydrated 1,3-bis(trifluoromethyl)benzene (produced by Tokyo Chemical Industry Co., Ltd.) | 15 ml |

Subsequently, a mixture of the following materials was added dropwise to the mixture of perfluorobutanesulfonyl fluoride and 1,3-bis(trifluoromethyl)benzene, which had been maintained at 0° C.

| | |
|---|---|
| PFPE diol ZDOL2000 (produced by Solvay Solexis company) | 15 g |
| Dehydrated triethylamine (produced by Tokyo Chemical Industry Co., Ltd.) | 1.67 g |

After the completion of dropping, the resulting mixture was maintained at 0° C. for 2 hours. Subsequently, the ice-water bath was removed, and the temperature inside the flask was increased to 25° C. Then, the reaction was carried out for 2 hours. Thus, PFPE-CF4 having the structure represented by Structural Formula CF4 was obtained.

Structural Formula CF4

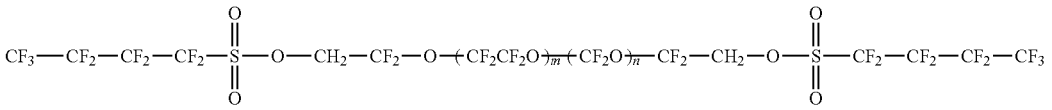

To a glass flask equipped with a stirrer, a reflux condenser, a nitrogen gas introduction tube, a thermostat, and a thermometer, 10 g of PFPE-CF4 was added, and the atmosphere was changed to a nitrogen atmosphere.

To the flask, 0.97 g of S-potassium thioacetate (produced by Tokyo Chemical Industry Co., Ltd.), 10 ml of ethanol (produced by KISHIDA CHEMICAL Co., Ltd.), and 10 ml of 1,3-bis(trifluoromethyl)benzene (produced by Tokyo Chemical Industry Co., Ltd.) were added. The resulting mixture was heated to 50° C. while being stirred and subsequently maintained at 50° C. for 4 hours.

Then, 0.1 mol/l hydrochloric acid (produced by KISHIDA CHEMICAL Co., Ltd.) was added to the reaction liquid to control the pH of the reaction liquid to be 6 or less. Thus, the reaction was completed, and PFPE-SME4 having a structure represented by Structural Formula SME4 was obtained.

Structural Formula SME4

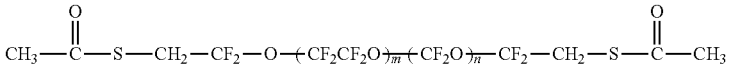

To a glass flask equipped with a stirrer, a nitrogen gas introduction tube, a thermostat, and a thermometer, 2 g of potassium hydroxide (produced by KISHIDA CHEMICAL Co., Ltd.) and 8 g of ethanol (produced by KISHIDA CHEMICAL Co., Ltd.) were added. The atmosphere was changed to a nitrogen atmosphere, and the resulting mixture was stirred at room temperature.

To the mixture, a mixture of 5 g of PFPE-SME4 and 5 ml of 1,3-bis(trifluoromethyl)benzene (produced by Tokyo Chemical Industry Co., Ltd.) was added dropwise. The resulting mixture was stirred for 2 hours at room temperature.

Subsequently, 0.1 mol/l hydrochloric acid (produced by KISHIDA CHEMICAL Co., Ltd.) was added to the reaction liquid to control the pH of the reaction liquid to be 6 or less. Thus, the reaction was completed, and PFPE-TH4 having a structure represented by Structural Formula TH4 was obtained.

Structural Formula TH4

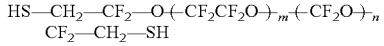

Measurement Method

The physical properties of the intermediate transfer belts prepared in Examples 1-1 to 1-16 and Comparative Examples 1-A to 1-J below and the physical properties of the photosensitive members for electrophotography prepared in Examples 2-1 to 2-4 and Comparative Examples 2-A to 2-E were determined by the following methods.

(1) Determination of Relaxation Time T2 by $^{19}$F-NMR (Nuclear Magnetic Resonance)

Only the outermost layer of each of the members for electrophotography prepared in Examples and Comparative Examples was shaved, and the resulting powder was analyzed by solid-state $^{19}$F-NMR (nuclear magnetic resonance) using "CMX-300" produced by Chemagnetics in a dry air at 22° C. The chemical shift reference standard used as an external reference was hexafluorobenzene, whose chemical shift was defined as −163 ppm. The analysis was conducted at a frequency of 282.436098 MHz over a spectral width of 200 kHz. Attenuation curves represented by Expressions (1)-1 and (1)-2 were fitted to the attenuation curves of the peak intensities observed in the measurement of relaxation times T1 and T2, respectively, using the method of least squares. Thus, the relaxation time T2 was determined.

$$I=I_\infty\times(1-2\exp(-t/T1)) \quad \text{Expression (1)-1}$$

(where I represents an intensity observed at time t, $I_\infty$ represents an intensity observed after a lapse of a sufficiently long time, t represents time, and T1 represents a longitudinal relaxation time)

$$I=I_0\times\exp(-t/T2) \quad \text{Expression (1)-2}$$

(where I represents an intensity observed at time t, $I_0$ represents an intensity observed at the moment when pulse wave irradiation is started, t represents time, and T2 represents a transverse relaxation time)

(2) Ratio of Number of Fluorine Atoms to Number of Carbon Atoms in Outermost Layer ((Number of Fluorine Atoms)/(Number of Carbon Atoms))

A platinum (Pt) film having a thickness of about 10 nm was formed on the surface of each of the outermost layers prepared in Examples and Comparative Examples by vapor deposition using an ion sputter E-1010 (produced by Hitachi High-Tech Fielding Corporation). The resulting samples were subjected to an elementary analysis using a tungsten filament scanning electron microscope (SEM) "VE-7800" (produced by Keyence Corporation) and the supplied energy dispersive X-ray spectrometer (EDX) "Genesis-XM1" (produced by EDAX Inc.). The acceleration voltage of the electron source was set to 15 kV, the spot size was set to 12, and the integration time was set to 60 seconds. The ratio of the number of fluorine atoms to the number of carbon atoms was determined using a quantitative analysis program (ZAF correction program) attached to "Genesis-XM1".

(3) Total Content of $CF_3$ Moieties, $CF_2$ Moieties, and CF Moieties in Binder Resin Each of the outermost layers prepared in Examples and Comparative Examples was dissolved in hexafluoroisopropanol (produced by Central Glass Co., Ltd.), and the dissolved component and the undissolved component were separated from each other. The dissolved component was fractionated using a splitter capable of separately collecting components fractionated by size exclusion chromatography. The resulting dissolved component was subjected to $^{1}$H-NMR, $^{13}$C-NMR, and $^{19}$F-NMR. The materials, structure, and content of the resin were confirmed by converting the peak positions and peak area ratios of hydrogen atoms, carbon atoms, and fluorine atoms. Using the results, the proportions of CF moieties, $CF_2$ moieties, and $CF_3$ moieties in the resin were calculated, and the proportions were converted into contents (mass ratios).

For the undissolved component, the proportions of CF moieties, $CF_2$ moieties, and $CF_3$ moieties in the resin were calculated, and the proportions were converted into contents (mass ratio) by solid-state NMR as described above.

Image Evaluation

For each of the intermediate transfer belts prepared in Examples 1-1 to 1-16 and Comparative Examples 1-A to 1-J and the photosensitive members for electrophotography prepared in Examples 2-1 to 2-4 and Comparative Examples 2-A to 2-E, the following image evaluation was conducted.

(1) Image Evaluation for Intermediate Transfer Belt

A polyimide intermediate transfer belt that was originally installed in "imageRUNNER ADVANCE C5051" produced by CANON KABUSHIKI KAISHA was replaced by each of the intermediate transfer belts prepared in Examples 1-1 to 1-16 and Comparative Examples 1-A to 1-J, and this machine was used for image evaluation. The recording medium used was plain paper 4024 (Xerox Multipurpose 4024, 201b) produced by Xerox Corporation. Images were printed in a high-temperature, high-humidity environment (30° C., 80% RH).

Blue solid image were printed for evaluation. An image printed at the time when 10,000 images had been printed (initial stage), an image printed at the time when 30,000 images had been printed, and an image printed at the time when 100,000 images had been printed were used for evaluation. Table 1 shows the evaluation results.

The images were evaluated in accordance with the following criteria:

A: Image unevenness was hardly observed

B: Image unevenness was partly observed

C: The image was not transferred sufficiently and a blank area was observed (2) Evaluation of Cleaning of Photosensitive Member for Electrophotography The photosensitive members for electrophotography prepared in Examples 2-1 to 2-4 and Comparative Examples 2-A to 2-E were evaluated as follows.

A monochrome laser printer "LaserJet 4300n" produced by Hewlett-Packard Company was used as an evaluation machine. Each of the photosensitive members for electrophotography was installed in the process cartridge of the evaluation machine. Using the evaluation machine, 2,000 images were printed, and occurrence of blade turning-up was evaluated at the time when 5 images had been printed (initial stage) and at the time when 2,000 images had been printed (after the durability test). In the evaluation, the cleaning blade was brought into contact with the surface of the electrophotographic photosensitive member at a linear pressure of 30 g/cm. The charging unit of the evaluation machine was a contact charging device including a charge roller. The evaluation was conducted in an environment of 23° C. and a humidity of 50% RH.

Presence or absence of blade turning-up was visually inspected and evaluated in accordance with the following criteria:

Initial Stage

A: Blade turning-up did not occur

B: Blade turning-up occurred

After durability test

AA: Blade turning-up did not occur until 2,000 images were printed

A: Blade turning-up occurred while 501 to 1,000 images were printed

B: Blade turning-up occurred while 101 to 500 images were printed

C: Blade turning-up occurred while 6 to 100 images were printed

Example 1-1

The following materials were mixed, and the resulting mixture was subjected to a dispersion treatment using a wet-type dispersion device NanoVater L-AS (produced by YOSHIDA KIKAI CO., LTD.) to obtain a coating liquid.

| | |
|---|---|
| Dipentaerythritol hexaacrylate (produced by Shin-Nakamura Chemical Co., Ltd.) | 15 parts by mass |
| Pentaerythritol tetraacrylate (produced by Shin-Nakamura Chemical Co., Ltd.) | 20 parts by mass |
| Antimony-doped tin oxide fine particles 20 mass % dispersion | 35 parts by mass |
| Methyl ethyl ketone | 50 parts by mass |
| 2-Propanol | 10 parts by mass |
| IRGACURE 184 (produced by BASF SE) | 2 parts by mass |
| PFPE-MAC3 | 30 parts by mass |
| Graft copolymer M50 | 20 parts by mass |

The intermediate transfer belt of "imageRUNNER ADVANCE C5051" produced by CANON KABUSHIKI KAISHA was used as a base layer. The coating liquid prepared above was applied onto the surface of the base layer by spray coating and dried at 70° C. for 3 minutes to remove the solvent. The resulting coating film was irradiated with ultraviolet radiation using a high-pressure mercury lamp to form an outermost layer so that the peak illuminance at 365 nm was 100 mW/cm$^2$ and the cumulative amount of ultraviolet radiation was 500 mJ/cm$^2$. Thus, an intermediate transfer belt 1-1 was prepared.

Example 1-2

An outermost layer was formed as in Example 1-1 except that the amount of PFPE-MAC3 used in Example 1-1 was changed to 12 parts by mass and the amount of graft copolymer M50 used in Example 1-1 was changed to 9 parts by mass. Thus, an intermediate transfer belt 1-2 was prepared.

Example 1-3

An outermost layer was formed as in Example 1-1 except that the amount of PFPE-MAC3 used in Example 1-1 was changed to 42 parts by mass and the graft copolymer M50 used in Example 1-1 was changed to 22 parts by mass of the graft copolymer M20 (powder having a solid content of 100%). Thus, an intermediate transfer belt 1-3 was prepared.

Example 1-4

An outermost layer was formed as in Example 1-1 except that PFPE-MAC3 used in Example 1-1 was changed to 30 parts by mass of PFPE-AR2 and 0.8 parts by mass of fluorine-containing diacrylate 1,6-Bis(acryloyloxy)-2,2,3,3,4,4,5,5-octafluorohexane (produced by Tokyo Chemical Industry Co., Ltd.) was further added to the coating liquid. Thus, an intermediate transfer belt 1-4 was prepared.

Example 1-5

An outermost layer was formed as in Example 1-1 except that PFPE-MAC3 used in Example 1-1 was changed to 30 parts by mass of PFPE-AR2 and 4 parts by mass of fluorine-containing diacrylate 1,6-Bis(acryloyloxy)-2,2,3,3,4,4,5,5-octafluorohexane (produced by Tokyo Chemical Industry Co., Ltd.) was further added to the coating liquid. Thus, an intermediate transfer belt 1-5 was prepared.

Example 1-6

An outermost layer was formed as in Example 1-1 except that dipentaerythritol hexaacrylate used in Example 1-1 was changed to 15 parts by mass of urethane acrylate U-4HA (produced by Shin-Nakamura Chemical Co., Ltd.). Thus, an intermediate transfer belt 1-6 was prepared.

Example 1-7

An outermost layer was formed as in Example 1-1 except that dipentaerythritol tetraacrylate used in Example 1-1 was changed to 15 parts by mass of epoxy acrylate EBECRYL3700 (produced by Daicel Corporation). Thus, an intermediate transfer belt 1-7 was prepared.

Example 1-8

An outermost layer was formed as in Example 1-1 except that dipentaerythritol hexaacrylate used in Example 1-1 was changed to 15 parts by mass of Karenz MT (produced by SHOWA DENKO K.K.). Thus, an intermediate transfer belt 1-8 was prepared.

Example 1-9

The following materials were mixed, and the resulting mixture was subjected to a dispersion treatment using a wet-type dispersion device NanoVater L-AS (produced by YOSHIDA KIKAI CO., LTD.) to obtain a coating liquid.

| | |
|---|---|
| CELLOXIDE 2021P (produced by Daicel Corporation) | 15 parts by mass |
| Silsesquioxane derivative TX-100 (produced by TOAGOSEI CO., LTD.) | 20 parts by mass |
| Antimony-doped tin oxide fine particles 20 mass % dispersion | 35 parts by mass |
| Methyl ethyl ketone | 50 parts by mass |
| 2-Propanol | 10 parts by mass |
| ADEKA OPTOMER SP-150 (produced by ADEKA corporation) | 2 parts by mass |
| PFPE-AR2 | 30 parts by mass |
| Graft copolymer M50 | 20 parts by mass |

The intermediate transfer belt of "imageRUNNER ADVANCE C5051" produced by CANON KABUSHIKI KAISHA was used as a base layer. The coating liquid prepared above was applied onto the surface of the base layer by spray coating and dried at 70° C. for 3 minutes to remove the solvent. The resulting coating film was irradiated with ultraviolet radiation using a high-pressure mercury lamp to form an outermost layer so that the peak illuminance at 365 nm was 100 mW/cm$^2$ and the cumulative amount of ultraviolet radiation was 500 mJ/cm$^2$. Thus, an intermediate transfer belt 1-9 was prepared.

Example 1-10

A coating liquid was prepared as in Example 1-1 except that PFPE-MAC3 used in Example 1-1 was changed to 30 parts by mass of PFPE-ACR1. The coating liquid was applied onto the base layer as in Example 1-1. Subsequently, the coating liquid deposited on the base layer was irradiated with an electron beam instead of ultraviolet radiation to form an outermost layer. Thus, an intermediate transfer belt 1-10 was prepared. The electron beam irradiation was performed in a nitrogen atmosphere at an acceleration voltage of 110 kV and at a beam current of 10.2 mA. The cumulative amount of electron beam radiation was 200 kGy.

Example 1-11

An outermost layer was formed as in Example 1-1 except that PFPE-MAC3 used in Example 1-1 was changed to 30 parts by mass of Fomblin MD40 (produced by Solvay Solexis company). Thus, an intermediate transfer belt 1-11 was prepared.

Example 1-12

An outermost layer was formed as in Example 1-1 except that PFPE-MAC3 used in Example 1-1 was changed to 30 parts by mass of ZDOL4000 (produced by Solvay Solexis company) and the graft copolymer M50 used in Example 1-1 was changed to 22 parts by mass of the graft copolymer M20. Thus, an intermediate transfer belt 1-12 was prepared.

Example 1-13

An outermost layer was formed as in Example 1-1 except that the amount of PFPE-TH4 used in Example 1-1 was changed to 30 parts by mass and the graft copolymer M50 used in Example 1-1 was changed to 20 parts by mass of the graft copolymer M20. Thus, an intermediate transfer belt 1-13 was prepared.

Example 1-14

An outermost layer was formed as in Example 1-1 except that the graft copolymer M50 used in Example 1-1 was changed to 80 parts by mass of Aron GF-400 (solid content: 25% by mass, produced by TOAGOSEI CO., LTD.). Thus, an intermediate transfer belt 1-14 was prepared.

Example 1-15

An outermost layer was formed as in Example 1-1 except that the amount of PFPE-MAC3 used in Example 1-1 was changed to 12 parts by mass and the graft copolymer M50 used in Example 1-1 was changed to 40 parts by mass of MEGAFACE F-555 (produced by DIC corporation, nonvolatile content: 30% by mass). Thus, an intermediate transfer belt 1-15 was prepared.

Example 1-16

An outermost layer was formed as in Example 1-1 except that IRGACURE 184 (produced by BASF SE) used in Example 1-1 was changed to 1.5 parts by mass of IRGACURE 500 (produced by BASF SE) and 0.5 parts by mass of IRGACURE 369 (produced by BASF SE). Thus, an intermediate transfer belt 1-16 was prepared.

Tables 1-1 and 1-2 show the types and amounts of the materials used in Examples 1-1 to 1-16. Table 1-3 shows the results of analyzing the outermost layers of the intermediate transfer belts 1-1 to 1-16 and the results of evaluating the intermediate transfer belts 1-1 to 1-16.

TABLE 1-1

| | | Example 1-1 | Example 1-2 | Example 1-3 | Example 1-4 | Example 1-5 | Example 1-6 | Example 1-7 | Example 1-8 |
|---|---|---|---|---|---|---|---|---|---|
| Polymerizable monomer | Dipentaerythritol hexaacrylate | 15 | 15 | 15 | 15 | 15 | | | |
| | Pentaerythritol tetraacrylate | 20 | 20 | 20 | 20 | 20 | 20 | 20 | 20 |
| | U-4HA | | | | | | 15 | | |
| | EBECRYL3700 | | | | | | | 15 | |
| | Karenz MT | | | | | | | | 15 |
| | CELLOXIDE 2021P | | | | | | | | |
| | TX-100 | | | | | | | | |
| Fluorine-containing polymerizable monomer | 1,6-Bis(acryloyloxy)-2,2,3,3,4,4,5,5,-octafluorohexane | | | | 0.8 | 4 | | | |
| Conducting agent | Antimony-doped tin oxide fine particles | 7 | 7 | 7 | 7 | 7 | 7 | 7 | 7 |
| Polymerization initiator | IRGACURE 184 | 2 | 2 | 2 | 2 | 2 | 2 | 2 | 2 |
| | IRGACURE 500 | | | | | | | | |
| | IRGACURE 369 | | | | | | | | |
| | SP-150 | | | | | | | | |
| PFPE | PFPE-ACR1 | | | | | | | | |
| | PFPE-AR2 | | | | 30 | 30 | | | |
| | PFPE-MAC3 | 30 | 12 | 42 | | | 30 | 30 | 30 |
| | PFPE-TH4 | | | | | | | | |
| | MD40 | | | | | | | | |
| | ZDOL4000 | | | | | | | | |
| Dispersing agent | Graft copolymer M50 | 20 | 9 | | 20 | 20 | 20 | 20 | 20 |
| | Graft copolymer M20 | | | 22 | | | | | |
| | GF-400 | | | | | | | | |
| | MEGAFACE F-555 | | | | | | | | |

TABLE 1-2

| | | Example 1-9 | Example 1-10 | Example 1-11 | Example 1-12 | Example 1-13 | Example 1-14 | Example 1-15 | Example 1-16 |
|---|---|---|---|---|---|---|---|---|---|
| Polymerizable monomer | Dipentaerythritol hexaacrylate | | 15 | 15 | 15 | 15 | 15 | 15 | 15 |
| | Pentaerythritol tetraacrylate | | 20 | 20 | 20 | 20 | 20 | 20 | 20 |
| | U-4HA | | | | | | | | |
| | EBECRYL3700 | | | | | | | | |
| | Karenz MT | | | | | | | | |
| | CELLOXIDE 2021P | 15 | | | | | | | |
| | TX-100 | 20 | | | | | | | |
| Fluorine-containing polymerizable monomer | 1,6-Bis(acryloyloxy)-2,2,3,3,4,4,5,5,-octafluorohexane | | | | | | | | |
| Conducting agent | Antimony-doped tin oxide fine particles | 7 | 7 | 7 | 7 | 7 | 7 | 7 | 7 |
| Polymerization initiator | IRGACURE 184 | | 2 | 2 | 2 | 2 | 2 | 2 | |
| | IRGACURE 500 | | | | | | | | 1.5 |
| | IRGACURE 369 | | | | | | | | 0.5 |
| | SP-150 | 2 | | | | | | | |
| PFPE | PFPE-ACR1 | | 30 | | | | | | |
| | PFPE-AR2 | 30 | | | | | | | |
| | PFPE-MAC3 | | | | | | 30 | 12 | 30 |
| | PFPE-TH4 | | | | | 30 | | | |
| | MD40 | | | 30 | | | | | |
| | ZDOL4000 | | | | 30 | | | | |
| Dispersing agent | Graft copolymer M50 | 20 | 20 | 20 | | | | | 20 |
| | Graft copolymer M20 | | | | 22 | 20 | | | |
| | GF-400 | | | | | | 20 | | |

TABLE 1-2-continued

| | Example 1-9 | Example 1-10 | Example 1-11 | Example 1-12 | Example 1-13 | Example 1-14 | Example 1-15 | Example 1-16 |
|---|---|---|---|---|---|---|---|---|
| MEGAFACE F-555 | | | | | | | 12 | |

TABLE 1-3

| | | Outermost layer analysis results | | | Image evaluation results | | |
|---|---|---|---|---|---|---|---|
| | Intermediate transfer belt No. | (Number of fluorine atoms)/(number of carbon atoms) | Relaxation time T2 (milliseconds) | Total sum of contents of $CF_3$ moieties, $CF_2$ moieties, and CF moieties in binder resin (mass %) | Initial stage | After printing 30,000 pages | After printing 100,000 pages |
| Example 1-1 | Intermediate transfer belt 1-1 | 0.19 | 22 | 0 | A | A | A |
| Example 1-2 | Intermediate transfer belt 1-2 | 0.11 | 20 | 0 | A | A | A |
| Example 1-3 | Intermediate transfer belt 1-3 | 0.38 | 23 | 0 | A | A | A |
| Example 1-4 | Intermediate transfer belt 1-4 | 0.20 | 24 | 1 | A | A | A |
| Example 1-5 | Intermediate transfer belt 1-5 | 0.21 | 24 | 4 | A | A | A |
| Example 1-6 | Intermediate transfer belt 1-6 | 0.19 | 22 | 0 | A | A | A |
| Example 1-7 | Intermediate transfer belt 1-7 | 0.19 | 22 | 0 | A | A | A |
| Example 1-8 | Intermediate transfer belt 1-8 | 0.19 | 21 | 0 | A | A | A |
| Example 1-9 | Intermediate transfer belt 1-9 | 0.20 | 24 | 0 | A | A | A |
| Example 1-10 | Intermediate transfer belt 1-10 | 0.20 | 13 | 0 | A | A | A |
| Example 1-11 | Intermediate transfer belt 1-11 | 0.29 | 37 | 0 | A | A | A |
| Example 1-12 | Intermediate transfer belt 1-12 | 0.31 | 40 | 0 | A | A | A |
| Example 1-13 | Intermediate transfer belt 1-13 | 0.19 | 16 | 0 | A | A | A |
| Example 1-14 | Intermediate transfer belt 1-14 | 0.19 | 20 | 0 | A | A | A |
| Example 1-15 | Intermediate transfer belt 1-15 | 0.19 | 23 | 0 | A | A | A |
| Example 1-16 | Intermediate transfer belt 1-16 | 0.19 | 20 | 0 | A | A | A |

Comparative Example 1-A

The following materials were mixed, and the resulting mixture was subjected to a dispersion treatment using a wet-type dispersion device NanoVater L-AS (produced by YOSHIDA KIKAI CO., LTD.) to obtain a coating liquid.

| | |
|---|---|
| Dipentaerythritol hexaacrylate (produced by Shin-Nakamura Chemical Co., Ltd.) | 15 parts by mass |
| Pentaerythritol tetraacrylate (produced by Shin-Nakamura Chemical Co., Ltd.) | 20 parts by mass |
| Antimony-doped tin oxide fine particles 20 mass % dispersion | 35 parts by mass |
| Methyl ethyl ketone | 50 parts by mass |
| 2-Propanol | 10 parts by mass |
| IRGACURE 184 (produced by BASF SE) | 2 parts by mass |

The intermediate transfer belt of "imageRUNNER ADVANCE C5051" produced by CANON KABUSHIKI KAISHA was used as a base layer. The coating liquid prepared above was applied onto the surface of the base layer by spray coating and dried at 70° C. for 3 minutes to remove the solvent. The resulting coating film was irradiated with ultraviolet radiation using a high-pressure mercury lamp to form an outermost layer so that the peak illuminance at 365 nm was 100 mW/cm$^2$ and the cumulative amount of ultraviolet radiation was 500 mJ/cm$^2$. Thus, an intermediate transfer belt 1-A was prepared.

Comparative Example 1-B

An outermost layer was formed as in Comparative Example 1-A except that 0.5 parts by mass of PFPE-MAC3 was further added to the coating liquid prepared in Comparative Example 1-A. Thus, an intermediate transfer belt 1-B was prepared.

Comparative Example 1-C

An outermost layer was formed as in Comparative Example 1-A except that 10 parts by mass of PFPE-MAC3 and 7 parts by mass of the graft copolymer M50 were further added to the coating liquid prepared in Comparative Example 1-A. Thus, an intermediate transfer belt 1-C was prepared.

Comparative Example 1-D

An outermost layer was formed as in Comparative Example 1-C except that dipentaerythritol hexaacrylate used in Comparative Example 1-C was changed to 15 parts by mass of urethane acrylate "U-4HA" (produced by Shin-Nakamura Chemical Co., Ltd.). Thus, an intermediate transfer belt 1-D was prepared.

Comparative Example 1-E

An outermost layer was formed as in Comparative Example 1-A except that the following materials were further added to the coating liquid prepared in Comparative Example 1-A. Thus, an intermediate transfer belt 1-E was prepared.

| | |
|---|---|
| PTFE particles ("Dyneon TF9207Z", produced by Sumitomo 3M Limited) | 20 parts by mass |
| Fluorine-containing surface-active agent ("MEGAFACE F-555", produced by DIC corporation, nonvolatile content: 30% by mass) | 3.3 parts by mass |

Comparative Example 1-F

An outermost layer was formed as in Comparative Example 1-A except that the following material was further added to the coating liquid prepared in Comparative Example 1-A. Thus, an intermediate transfer belt 1-F was prepared.

| | |
|---|---|
| Fluorine-containing surface-active agent ("MEGAFACE F-555", produced by DIC corporation, nonvolatile content: 30% by mass) | 70 parts by mass |

Comparative Example 1-G

An outermost layer was formed as in Comparative Example 1-A except that the following materials were further added to the coating liquid prepared in Comparative Example 1-A. Thus, an intermediate transfer belt 1-G was prepared.

| | |
|---|---|
| Fluorine-containing diacrylate 1,6-Bis(acryloyloxy)-2,2,3,3,4,4,5,5-octafluorohexane (produced by Tokyo Chemical Industry Co., Ltd.) | 5 parts by mass |
| PFPE-AR2 | 30 parts by mass |
| Graft copolymer M50 | 30 parts by mass |

Comparative Example 1-H

The following materials were mixed, and the resulting mixture was subjected to a dispersion treatment using a wet-type dispersion device NanoVater L-AS (produced by YOSHIDA KIKAI CO., LTD.) to obtain a coating liquid.

| | |
|---|---|
| CYTOP CTX-109A (produced by ASAHI GLASS CO., LTD., solid content: 9% by mass) | 300 parts by mass |

-continued

| | |
|---|---|
| Potassium nonafluorobutanesulfonate (produced by Mitsubishi Materials Electronic Chemicals Co., Ltd.) | 3 parts by mass |
| PFPE-MAC3 | 10 parts by mass |
| Fluorine-containing surface-active agent ("MODIPER F600", produced by NOF CORPORATION) | 10 parts by mass |

The intermediate transfer belt of "imageRUNNER ADVANCE C5051" produced by CANON KABUSHIKI KAISHA was used as a base layer. The coating liquid prepared above was applied onto the surface of the base layer by spray coating, and the solvent was removed from the coating liquid deposited on the surface of the base layer. The resulting coating film was maintained at 200° C. for 1 hour. Thus, an intermediate transfer belt 1-H was prepared.

Comparative Example 1-I

An outermost layer was formed as in Comparative Example 1-A except that the following materials were further added to the coating liquid prepared in Comparative Example 1-A. Thus, an intermediate transfer belt 1-I was prepared.

| | |
|---|---|
| PFPE-MAC3 (produced by Solvay Solexis company) | 40 parts by mass |
| Fluorine-containing surface-active agent ("MODIPER F600", produced by NOF CORPORATION) | 40 parts by mass |
| Comparative Example 1-J | |

To the coating liquid prepared in Comparative Example 1-A, 30 parts by mass of Fluorolink 5113X (produced by Solvay Solexis company) and 10 parts of the graft copolymer M50 were further added, and the resulting mixture was subjected to a dispersion treatment. Thus, a coating liquid 1-J was obtained.

The coating liquid was applied onto the base layer and dried as in Comparative Example 1-A. Subsequently, the coating liquid deposited on the base layer was irradiated with an electron beam to form an outermost layer. Thus, an intermediate transfer belt 1-J was prepared. The electron beam irradiation was performed in a nitrogen atmosphere at an acceleration voltage of 110 kV and at a beam current of 12.8 mA. The cumulative amount of electron beam radiation was 1,000 kGy.

Table 1-4 shows the types and amounts of the materials used in Comparative Examples 1-A to 1-J. Table 1-5 shows the results of analyzing the outermost layers of the intermediate transfer belts 1-A to 1-J and the results of evaluating the intermediate transfer belts 1-A to 1-J.

TABLE 1-4

| | | Comparative Example 1-A | Comparative Example 1-B | Comparative Example 1-C | Comparative Example 1-D | Comparative Example 1-E | Comparative Example 1-F | Comparative Example 1-G | Comparative Example 1-H | Comparative Example 1-I | Comparative Example 1-J |
|---|---|---|---|---|---|---|---|---|---|---|---|
| Polymerizable monomer | Dipentaerythritol hexaacrylate | 15 | 15 | 15 | | 15 | 15 | 15 | | 15 | 15 |
| | Pentaerythritol tetraacrylate | 20 | 20 | 20 | 20 | 20 | 20 | 20 | | 20 | 20 |
| | U-4HA | | | | 15 | | | | | | |
| | EBECRYL3700 | | | | | | | | | | |
| | Karenz MT | | | | | | | | | | |
| | CELLOXIDE 2021P | | | | | | | | | | |
| | TX-100 | | | | | | | | | | |
| Fluorine-containing polymerizable monomer | 1,6-Bis(acryloyloxy)-2,2,3,3,4,4,5,5,-octafluorohexane | | | | | | | 5 | | | |
| Fluorocarbon polymer | CYTOP CTX-109A | | | | | | | | 27 | | |
| Fluorine particles | Dyneon TF9207Z | | | | | 20 | | | | | |
| Conducting agent | Antimony-doped tin oxide fine particles | 7 | 7 | 7 | 7 | 7 | 7 | 7 | | 7 | 7 |
| | Potassium nonafluorobutanesulfonate | | | | | | | | 3 | | |
| Polymerization initiator | IRGACURE 184 | 2 | 2 | 2 | 2 | 2 | 2 | 2 | | 2 | 2 |
| | IRGACURE 500 | | | | | | | | | | |
| | IRGACURE 369 | | | | | | | | | | |
| | SP-150 | | | | | | | | | | |
| PFPE | PFPE-ACR1 | | | | | | | | | | |
| | PFPE-AR2 | | | | | | | 30 | | | |
| | PFPE-MAC3 | | 0.5 | 10 | 10 | | | | 10 | 40 | |
| | PFPE-TH4 | | | | | | | | | | |
| | 5113X | | | | | | | | | | 30 |
| | MD40 | | | | | | | | | | |
| | ZDOL4000 | | | | | | | | | | |
| Dispersing agent | Graft copolymer M50 | | | 7 | 7 | | | 30 | | | 10 |
| | Graft copolymer M20 | | | | | | | | | | |
| | GF-400 | | | | | | | | | | |
| | MODIPER F600 | | | | | | | | 10 | 40 | |
| | MEGAFACE F-555 | | | | | 1 | 21 | | | | |

TABLE 1-5

| | | Outermost layer analysis results | | | Image evaluation results | | |
|---|---|---|---|---|---|---|---|
| | Intermediate transfer belt No. | (Number of fluorine atoms)/(number of carbon atoms) | Relaxation time T2 (milliseconds) | Total sum of contents of $CF_3$ moieties, $CF_2$ moieties, and CF moieties in binder resin (mass %) | Initial stage | After printing 30,000 pages | After printing 100,000 pages |
| Comparative Example 1-A | Intermediate transfer belt 1-A | 0 | — | 0 | C | C | C |
| Comparative Example 1-B | Intermediate transfer belt 1-B | 0.05 | 20 | 0 | A | C | C |
| Comparative Example 1-C | Intermediate transfer belt 1-C | 0.09 | 21 | 0 | A | C | C |
| Comparative Example 1-D | Intermediate transfer belt 1-D | 0.09 | 21 | 0 | A | C | C |
| Comparative Example 1-E | Intermediate transfer belt 1-E | 0.15 | 1 | 0 | A | C | C |
| Comparative Example 1-F | Intermediate transfer belt 1-F | 0.11 | 1 | 0 | A | C | C |
| Comparative Example 1-G | Intermediate transfer belt 1-G | 0.19 | 22 | 6 | A | C | C |
| Comparative Example 1-H | Intermediate transfer belt 1-H | 0.64 | 22 | 19 | A | C | C |

TABLE 1-5-continued

| | | Outermost layer analysis results | | | Image evaluation results | | |
|---|---|---|---|---|---|---|---|
| | Intermediate transfer belt No. | (Number of fluorine atoms)/(number of carbon atoms) | Relaxation time T2 (milliseconds) | Total sum of contents of $CF_3$ moieties, $CF_2$ moieties, and CF moieties in binder resin (mass %) | Initial stage | After printing 30,000 pages | After printing 100,000 pages |
| Comparative Example 1-I | Intermediate transfer belt 1-I | 0.42 | 23 | 0 | A | C | C |
| Comparative Example 1-J | Intermediate transfer belt 1-J | 0.17 | 12 | 0 | A | C | C |

Example 2-1

Undercoating Layer

An aluminium cylinder having a diameter of 30 mm and a length of 260 mm was used as a support.

The following materials were charged in a sand mill with glass beads having a diameter of 1 mm:

| | |
|---|---|
| Titanium oxide particles coated with tin oxide containing 10 mass % antimony oxide | 50 parts by mass |
| Resol-type phenolic resin | 25 parts by mass |
| Methoxypropanol | 30 parts by mass |
| Methanol | 30 parts by mass |
| Silicone oil (polydimethylsiloxane-polyoxyalkylene copolymer, weight-average molecular weight: 3,000) | 0.002 parts by mass |

The resulting mixture was subjected to a dispersion treatment for 2 hours to prepare a conductive-layer coating liquid. The conductive-layer coating liquid was applied onto the support by dip coating, and the resulting coating film was cured at 140° C. for 20 minutes. Thus, a conductive layer having a thickness of 20 μm was formed.

Subsequently, 5 parts of N-methoxymethyl 6-nylon was dissolved in 95 parts of methanol to prepare an undercoating-layer coating liquid. The undercoating-layer coating liquid was applied onto the conductive layer by dip coating, and the resulting coating film was dried at 100° C. for 20 minutes. Thus, an undercoating layer having a thickness of 0.5 μm was formed.

Charge Generation Layer

The following materials were charged in a sand mill with glass beads having a diameter of 1 mm and subjected to a dispersion treatment for 1 hour.

| | |
|---|---|
| A hydroxygallium phthalocyanine crystal (charge generation material) having a crystal form in which strong peaks are observed at Bragg angles (2θ ± 0.2°) of 7.5°, 9.9°, 12.5°, 16.3°, 18.6°, 25.1°, and 28.3° in CuKα characteristics X-ray diffraction | 10 parts by mass |
| The compound represented by Structural Formula (2-1) below | 0.1 parts by mass |
| Polyvinyl butyral ("S-LEC BX-1", produced by SEKISUI CHEMICAL CO., LTD.) | 5 parts by mass |
| Cyclohexanone | 250 parts by mass |

To the resulting mixture, 250 parts by mass of ethyl acetate was added to prepare a charge-generation-layer coating liquid. The charge-generation-layer coating liquid was applied onto the undercoating layer by dip coating, and the resulting coating film was dried at 100° C. for 10 minutes. Thus, a charge generation layer having a thickness of 0.16 μm was formed.

Structural Formula (2-1)

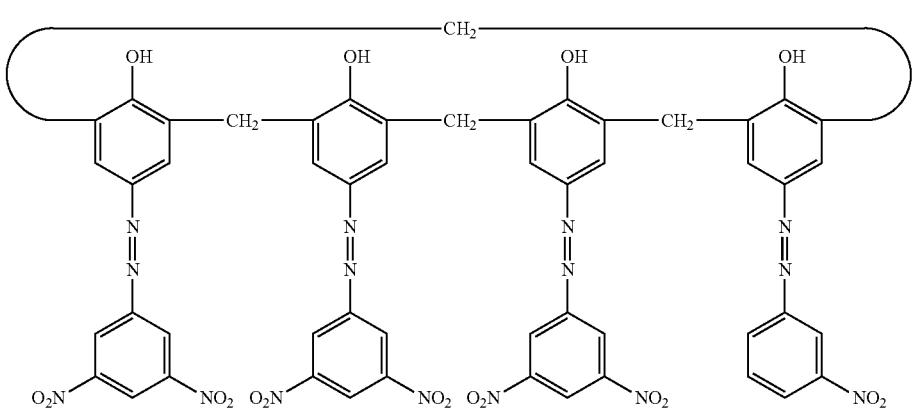

Charge Transportation Layer

The following materials were dissolved in 300 parts of monochlorobenzene to prepare a charge-transportation-layer coating liquid.

| | |
|---|---|
| The compound (charge transport material) represented by Structural Formula (2-2) below | 40 parts by mass |
| The compound (charge transport material) represented by Structural Formula (2-3) below | 5 parts by mass |
| Polyarylate (weight-average molecular weight: 115,000, the molar ratio of terephthalic acid frame to isophthalic acid frame: terephthalic acid frame/isophthalic acid frame = 50/50) having the structural unit represented by Structural Formula (2-4) below | 50 parts by mass |

The charge-transportation-layer coating liquid was applied onto the charge generation layer by dip coating, and the resulting coating film was dried at 120° C. for 1 hour. Thus, a charge transportation layer having a thickness of 25 μm was formed.

Structural Formula (2-2)

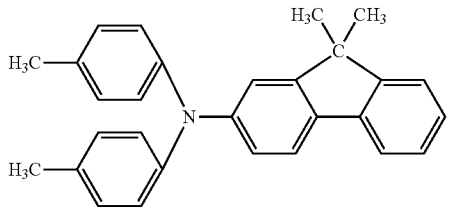

Structural Formula (2-3)

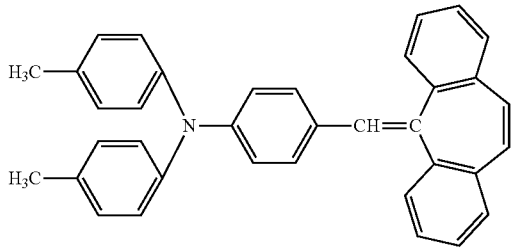

Structural Formula (2-4)

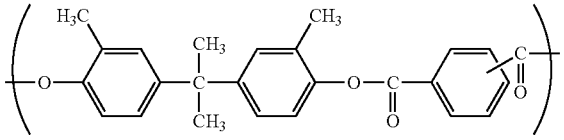

Protective Layer

The following materials were mixed, and the resulting mixture was subjected to a dispersion treatment using a wet-type dispersion device "NanoVater L-AS" (produced by YOSHIDA KIKAI CO., LTD.) to prepare a protective-layer coating liquid.

| | |
|---|---|
| Dipentaerythritol hexaacrylate (produced by Shin-Nakamura Chemical Co., Ltd.) | 15 parts by mass |
| Pentaerythritol tetraacrylate (produced by Shin-Nakamura Chemical Co., Ltd.) | 20 parts by mass |
| Methyl ethyl ketone | 70 parts by mass |
| Antimony-doped tin oxide fine particles 20 mass % dispersion | 30 parts by mass |

-continued

| | |
|---|---|
| 2-Propanol | 15 parts by mass |
| IRGACURE 184 (produced by BASF SE) | 2 parts by mass |
| PFPE-AR2 | 30 parts by mass |
| Graft copolymer M20 | 15 parts by mass |

The protective-layer coating liquid was applied onto the charge transportation layer by dip coating and dried at 70° C. for 3 minutes to remove the solvent. The resulting coating film was irradiated with ultraviolet radiation using a high-pressure mercury lamp so that the peak illuminance at 365 nm was 100 mW/cm$^2$ and the cumulative amount of ultraviolet radiation was 1,000 mJ/cm$^2$ to form a protective layer having a thickness of about 4 μm.

As described above, a photosensitive member for electrophotography including a support, a conductive layer, an undercoating layer, a charge generation layer, a charge transportation layer, and a protective layer that was an outermost layer was prepared. This photosensitive member for electrophotography is herein referred to as "electrophotographic photosensitive member 2-1".

Example 2-2

A photosensitive member for electrophotography was prepared as in Example 2-1 except that the amount of PFPE-AR2 and the amount of graft copolymer M20 that were used for preparing the protective-layer coating liquid in Example 2-1 were changed to 12 parts by mass and 6 parts by mass, respectively. This photosensitive member for electrophotography is herein referred to as "electrophotographic photosensitive member 2-2".

Example 2-3

A photosensitive member for electrophotography was prepared as in Example 2-1 except that the amount of PFPE-AR2 and the amount of graft copolymer M20 that were used for preparing the protective-layer coating liquid in Example 2-1 were changed to 42 parts by mass and 21 parts by mass, respectively. This photosensitive member for electrophotography is herein referred to as "electrophotographic photosensitive member 2-3".

Example 2-4

A photosensitive member for electrophotography was prepared as in Example 2-1 except that PFPE-AR2 used for preparing the protective-layer coating liquid in Example 2-1 was changed to 30 parts by mass of PFPE-ACR1 and the protective layer was cured by being irradiated with an electron beam instead of ultraviolet radiation. This photosensitive member for electrophotography is herein referred to as "electrophotographic photosensitive member 2-4".

The electron beam irradiation was performed in a nitrogen atmosphere at an acceleration voltage of 110 kV and at a beam current of 10.2 mA. The cumulative amount of electron beam radiation was 200 kGy.

Table 2-1 shows the types and amounts of the materials used in Examples 2-1 to 2-4. Table 2-2 shows the results of analyzing the outermost layers of the electrophotographic photosensitive members 2-1 to 2-4 and the results of evaluating the electrophotographic photosensitive members 2-1 to 2-4.

TABLE 2-1

| | | Example 2-1 | Example 2-2 | Example 2-3 | Example 2-4 |
|---|---|---|---|---|---|
| Polymerizable monomer | Dipentaerythritol hexaacrylate | 15 | 15 | 15 | 15 |
| | Pentaerythritol tetraacrylate | 20 | 20 | 20 | 20 |
| Fluorocarbon polymer | CYTOP CTX-109A | | | | |
| Conducting agent | Antimony-doped tin oxide fine particles | 6 | 6 | 6 | 6 |
| Polymerization initiator | IRGACURE 184 | 2 | 2 | 2 | 2 |
| PFPE | PFPE-ACR1 | | | | 30 |
| | PFPE-AR2 | 30 | 12 | 42 | |
| | PFPE-MAC3 | | | | |
| Dispersing agent | Graft copolymer M50 | | | | |
| | Graft copolymer M20 | 15 | 6 | 21 | 15 |

TABLE 2-2

| | | Outermost layer analysis results | | | Cleaning evaluation results | |
|---|---|---|---|---|---|---|
| | Electrophotographic photosensitive member No. | (Number of fluorine atoms)/(number of carbon atoms) | Relaxation time T2 (milliseconds) | Total sum of contents of $CF_3$ moieties, $CF_2$ moieties, and CF moieties in binder resin (mass %) | Initial stage | After durability test |
| Example 2-1 | Electrophotographic photosensitive member 2-1 | 0.19 | 23 | 0 | A | AA |
| Example 2-2 | Electrophotographic photosensitive member 2-2 | 0.11 | 23 | 0 | A | AA |
| Example 2-3 | Electrophotographic photosensitive member 2-3 | 0.38 | 23 | 0 | A | AA |
| Example 2-4 | Electrophotographic photosensitive member 2-4 | 0.19 | 13 | 0 | A | AA |

Comparative Example 2-A

The following materials were mixed, and the resulting mixture was subjected to a dispersion treatment using a wet-type dispersion device "NanoVater L-AS" (produced by YOSHIDA KIKAI CO., LTD.) to prepare a protective-layer coating liquid.

| | |
|---|---|
| Dipentaerythritol hexaacrylate (produced by Shin-Nakamura Chemical Co., Ltd.) | 15 parts by mass |
| Pentaerythritol tetraacrylate (produced by Shin-Nakamura Chemical Co., Ltd.) | 20 parts by mass |
| Antimony-doped tin oxide fine particles 20 mass % dispersion | 30 parts by mass |
| Methyl ethyl ketone | 70 parts by mass |
| 2-Propanol | 15 parts by mass |
| IRGACURE 184 (produced by BASF SE) | 2 parts by mass |

A photosensitive member for electrophotography was prepared as in Example 2-1 except that the protective-layer coating liquid prepared in Comparative Example 2-A was used. This photosensitive member for electrophotography is herein referred to as "electrophotographic photosensitive member 2-A".

In the evaluation of the electrophotographic photosensitive member 2-A, an evaluation after the durability test was omitted because blade turning-up was observed at the initial stage of printing.

Comparative Example 2-B

A photosensitive member for electrophotography was prepared as in Example 2-1 except that the amount of PFPE-AR2 used for preparing the protective-layer coating liquid in Example 2-1 was changed to 10 parts by mass and the graft copolymer M20 used for preparing the protective-layer coating liquid in Example 2-1 was changed to 7 parts by mass of the graft copolymer M50. This photosensitive member for electrophotography is herein referred to as "electrophotographic photosensitive member 2-B".

Comparative Example 2-C

A photosensitive member for electrophotography was prepared as in Comparative Example 2-A except that 70 parts by mass of MEGAFACE F-555 (produced by DIC corporation, nonvolatile content: 30% by mass) was further added to the protective-layer coating liquid prepared in Comparative Example 2-A. This photosensitive member for electrophotography is herein referred to as "electrophotographic photosensitive member 2-C".

Comparative Example 2-D

A photosensitive member for electrophotography was prepared as in Example 2-1 except that PFPE-AR2 and the graft copolymer M20 used for preparing the protective-layer coating liquid in Example 2-1 were changed to 30 parts by mass of Fluorolink 5113X and 10 parts by mass of the graft copolymer M50, respectively. This photosensitive member for electrophotography is herein referred to as "electrophotographic photosensitive member 2-D".

Comparative Example 2-E

The following materials were mixed, and the resulting mixture was subjected to a dispersion treatment using a wet-type dispersion device "NanoVater L-AS" (produced by YOSHIDA KIKAI CO., LTD.) to prepare a protective-layer coating liquid.

| | |
|---|---|
| CYTOP CTX-109A (produced by ASAHI GLASS CO., LTD., solid content: 9% by mass) | 300 parts by mass |
| Potassium nonafluorobutanesulfonate (produced by Mitsubishi Materials Electronic Chemicals Co., Ltd.) | 3 parts by mass |

-continued

| | |
|---|---|
| PFPE-MAC3 | 10 parts by mass |
| MODIPER F600 | 10 parts by mass |

The protective-layer coating liquid was applied onto the charge transportation layer prepared in Example 2-1 by dip coating and dried at 70° C. for 3 minutes to remove the solvent. The resulting coating film was maintained at 120° C. for 2 hours to form a protective layer. The resulting photosensitive member for electrophotography is herein referred to as "electrophotographic photosensitive member 2-E".

Table 2-3 shows the types and amounts of the materials used in Comparative Examples 2-A to 2-E. Table 2-4 shows the results of analyzing the outermost layers of the electrophotographic photosensitive members 2-A to 2-E and the results of evaluating the electrophotographic photosensitive members 2-A to 2-E.

TABLE 2-3

| | | Comparative Example 2-A | Comparative Example 2-B | Comparative Example 2-C | Comparative Example 2-D | Comparative Example 2-E |
|---|---|---|---|---|---|---|
| Polymerizable monomer | Dipentaerythritol hexaacrylate | 15 | 15 | 15 | 15 | |
| | Pentaerythritol tetraacrylate | 20 | 20 | 20 | 20 | |
| Fluorocarbon polymer | CYTOP CTX-109A | | | | | 27 |
| Conducting agent | Antimony-doped tin oxide fine particles | 6 | 6 | 6 | 6 | |
| | Potassium nonafluorobutanesulfonate | | | | | 3 |
| Polymerization initiator | IRGACURE 184 | 2 | 2 | 2 | 2 | |
| PFPE | PFPE-ACR1 | | | | | |
| | PFPE-AR2 | | 10 | | | |
| | PFPE-MAC3 | | | | | 10 |
| | 5113X | | | | 30 | |
| Dispersing agent | Graft copolymer M50 | | 7 | | 10 | |
| | Graft copolymer M20 | | | | | |
| | MODIPER F600 | | | | | 10 |
| | MEGAFACE F-555 | | | 21 | | |

TABLE 2-4

| | | Outermost layer analysis results | | | Cleaning evaluation results | |
|---|---|---|---|---|---|---|
| | Electrophotographic photosensitive member No. | (Number of fluorine atoms)/(number of carbon atoms) | Relaxation time T2 (milliseconds) | Total sum of contents of $CF_3$ moieties, $CF_2$ moieties, and CF moieties in binder resin (mass %) | Initial stage | After durability test |
| Comparative Example 2-A | Electrophotographic photosensitive member 2-A | 0 | — | 0 | B | — |
| Comparative Example 2-B | Electrophotographic photosensitive member 2-B | 0.09 | 23 | 0 | A | A |
| Comparative Example 2-C | Electrophotographic photosensitive member 2-C | 0.11 | 1 | 0 | A | B |
| Comparative Example 2-D | Electrophotographic photosensitive member 2-D | 0.17 | 12 | 0 | A | B |
| Comparative Example 2-E | Electrophotographic photosensitive member 2-E | 0.64 | 20 | 19 | A | B |

According to the present invention, a member for electrophotography capable of maintaining toner releasability and resistance to friction even when images are repeatedly transferred from or onto the member for electrophotography and capable of producing good images over a long period of time may be provided. Furthermore, a process cartridge and an electrophotographic apparatus that include the member for electrophotography may be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-133200, filed Jun. 25, 2013, which is hereby incorporated by reference herein in its entirety.

What is claimed is:

1. A member for electrophotography having a multilayer structure or a single-layer structure, comprising an outermost layer which satisfies the following A, B and C:

A: the outermost layer has perfluoropolyether and a binder resin, and in the outermost layer, the ratio of the number of fluorine atoms to the number of carbon atoms ((number of fluorine atoms)/(number of carbon atoms)) is 0.10 or more and 0.40 or less;

B: in a $^{19}$F-NMR spectrum of the outermost layer, the relaxation time T2 of a peak derived from $CF_2$ moieties of perfluoropolyether is 13 milliseconds or more at 22° C.; and C: the total sum of the contents of $CF_3$ moieties, $CF_2$ moieties, and CF moieties in the binder resin is 5% by mass or less.

2. The member for electrophotography according to claim 1, wherein the relaxation time T2 is 13 milliseconds or more and 50 milliseconds or less.

3. The member for electrophotography according to claim 1, wherein the binder resin is an acrylic resin.

4. The member for electrophotography according to claim 1, wherein the content of perfluoropolyether is 10.0% by mass or more and 70.0% by mass or less based on the total solid content in the outermost layer.

5. The member for electrophotography according to claim 1, wherein the outermost layer further comprises a dispersing agent for dispersing the perfluoropolyether.

6. The member for electrophotography according to claim 5, wherein the dispersing agent comprises at least one of:

a block copolymer produced by copolymerization of a vinyl monomer having a fluoroalkyl group with an acrylate or a methacrylate, and a comb-like graft copolymer produced by copolymerization of an acrylate having a fluoroalkyl group or a methacrylate having a fluoroalkyl group with a methacrylate macromonomer having a polymethyl methacrylate as a side chain.

7. The member for electrophotography according to claim 1, serving as an intermediate transfer member for electrophotography or a photosensitive member for electrophotography.

8. A process cartridge detachably attachable to a main body of an electrophotographic apparatus, comprising the member for electrophotography according to claim 1.

9. An electrophotographic apparatus comprising the member for electrophotography according to claim 1.

* * * * *